US010804648B2

(12) United States Patent
Urashima et al.

(10) Patent No.: US 10,804,648 B2
(45) Date of Patent: Oct. 13, 2020

(54) CONNECTOR HOUSING

(71) Applicant: YAZAKI CORPORATION, Tokyo (JP)

(72) Inventors: Tomohiro Urashima, Tochigi (JP); Masashi Nakamura, Tochigi (JP); Yoshiharu Ishii, Tochigi (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/985,575

(22) Filed: May 21, 2018

(65) Prior Publication Data

US 2018/0351302 A1 Dec. 6, 2018

(30) Foreign Application Priority Data

Jun. 1, 2017 (JP) ..... 2017-109220

(51) Int. Cl.
*H01R 13/405* (2006.01)
*H01R 13/629* (2006.01)
(Continued)

(52) U.S. Cl.
CPC ..... *H01R 13/64* (2013.01); *H01R 13/405* (2013.01); *H01R 13/424* (2013.01); *H01R 13/50* (2013.01);
(Continued)

(58) Field of Classification Search
CPC .... H01R 13/64; H01R 13/405; H01R 13/424; H01R 13/50; H01R 13/504; H01R 13/629;
(Continued)

(56) References Cited

U.S. PATENT DOCUMENTS 6,162,092 A * 12/2000 Lin ..... H01R 13/6392 439/574
7,806,720 B2 * 10/2010 Omori ..... H01R 9/03 439/507
(Continued)

FOREIGN PATENT DOCUMENTS

CN 101689740 A 3/2010
CN 102844938 A 12/2012
(Continued)

OTHER PUBLICATIONS

Chinese Office Action for the related Chinese Patent Application No. 201810558507.7 dated Jul. 3, 2019.

*Primary Examiner* — Nguyen Tran
*Assistant Examiner* — Paul D Baillargeon
(74) *Attorney, Agent, or Firm* — Kenealy Vaidya LLP

(57) ABSTRACT

A connector housing includes a first side wall and a second side wall. The first side wall is to be pressed against a cylindrical member extending in a first direction. The second side wall is opposed to the first side wall in a second direction perpendicular to the first direction. The second side wall is formed with a front-side rib at one end in the first direction and a rear-side rib at the other end in the first direction. The front-side rib protrudes in the second direction and extends in a third direction perpendicular to both the first direction and the second direction. The rear-side rib projects in the second direction and extends in the third direction. The front-side rib and the second side rib do not face to each other in the first direction.

8 Claims, 29 Drawing Sheets

(51) Int. Cl.

| | |
|---|---|
| ***H01R 13/50*** | (2006.01) |
| ***H01R 13/518*** | (2006.01) |
| ***H01R 13/73*** | (2006.01) |
| ***H01R 13/424*** | (2006.01) |
| ***H01R 13/504*** | (2006.01) |
| ***H01R 13/64*** | (2006.01) |

(52) U.S. Cl.
CPC ..... *H01R 13/504* (2013.01); *H01R 13/518* (2013.01); *H01R 13/629* (2013.01); *H01R 13/73* (2013.01)

(58) Field of Classification Search
CPC ..... H01R 13/514; H01R 13/518; H01R 9/16; H01R 13/639
See application file for complete search history.

(56) References Cited

U.S. PATENT DOCUMENTS

| | | | | |
|---|---|---|---|---|
| 9,197,007 | B2 * | 11/2015 | Shinmi ..... | H01R 13/5804 |
| 2010/0144193 | A1 | 6/2010 | Omori et al. | |
| 2011/0126934 | A1 | 6/2011 | Thuesen | |
| 2011/0223784 | A1 | 9/2011 | Jiang et al. | |
| 2011/0223785 | A1 | 9/2011 | Jiang et al. | |
| 2015/0136477 | A1 | 5/2015 | Suzuki et al. | |
| 2017/0098913 | A1 | 4/2017 | Imai | |

FOREIGN PATENT DOCUMENTS

| | | | |
|---|---|---|---|
| CN | 104508914 | A | 4/2015 |
| JP | 2006-49199 | A | 2/2006 |
| JP | 2009-170289 | A | 7/2009 |
| JP | 2015-198005 | A | 11/2015 |

* cited by examiner

CONNECTOR HOUSING

CROSS-REFERENCES TO RELATED APPLICATIONS

This application is based on and claims priority from Japanese Patent Applications No. 2017-109220 filed on Jun. 1, 2017, the entire contents of which are incorporated herein by reference.

BACKGROUND

1. Field of the Invention

The invention relates to a connector housing.

2. Description of Related Art

JP-A-2009-170289 discloses a connector housing fixed to an outer peripheral surface of an electric wire bundle. So as to fix the connector housing to the electric wire bundle, a tape is collectively wound around the outer peripheral surface of the electric wire bundle and an outer peripheral surface of the connector housing.

In the connector housing of JP-A-2009-170289, on a side wall of the connector housing in an opposite side of a side wall at which the connecting housing is in contact with the electric wire bundle, ribs project outward are provided. The tape is wound along the ribs. This configuration would suppress displacement of the tape.

For facilitation of the tape winding, a pair of ribs may be provided on the side wall in the opposite side of the side wall at which the connector housing is contacted with the electric wire bundle, and the tape may be wound between the pair of ribs. The connector housing of JP-A-2009-170289 may be modified by adding another rib at a position where it faces a previously formed rib.

However, when the above connector housing is resin molded using a mold set, the molding process thereof tends to be complicated. When the connector housing is molded using the mold set, a separating direction of two molds is set in a longitudinal direction of an electric wire side terminal. However, in order to form a space which is sandwiched between the two ribs, it is necessary to use a slide core which slides in a direction orthogonal to the separating direction.

Therefore, the molding process of the connector housing tends to be complicated since the slide core is required.

SUMMARY

Embodiments relates to a connector housing which is to be attached on an outer peripheral surface of a cylindrical member and is wound with tape together with the cylindrical member, and in which its molding process would be simplified.

In accordance with one or more embodiments, in a connector housing having a cylindrical shape, the connector housing includes a first side wall in an outer peripheral of the connector housing and a second side wall in the outer peripheral of the connector housing. The first side wall is to be pressed against a cylindrical member extending in a first direction. The second side wall is opposed to the first side wall in a second direction perpendicular to the first direction. The second side wall is formed with a front-side rib at one end of the second side wall in the first direction and a rear-side rib at the other end of the second side wall in the first direction. The front-side rib protrudes from the second side wall in the second direction and extends in a third direction which is perpendicular to both the first direction and the second direction. The rear-side rib projects from the second side wall in the second direction and extends in the third direction. The front-side rib and the second side rib do not face to each other in the first direction.

In accordance with one or more embodiments, in a connector housing having a cylindrical shape, the connector housing includes a first side wall in an outer peripheral of the connector housing and a second side wall in the outer peripheral of the connector housing. The first side wall is to be pressed against a cylindrical member extending in a first direction. The second side wall is opposed to the first side wall in a second direction perpendicular to the first direction. The second side wall is formed with a rib. The rib protrudes from the second side wall in the second direction and extend in a third direction which is perpendicular to both the first direction and the second direction. The rib is formed at only one end of the second side wall in the first direction.

Other aspects and advantages of the invention will be apparent from the following description and the appended claims.

DETAILED DESCRIPTION

Connector housings according to exemplary embodiments are described with reference to drawings.

First Embodiment

Firstly, referring to FIGS. 1 to 5, description is given of a connector housing 10 according to a first embodiment.

A resin-made connector housing 10 is a housing of a joint connector to be engaged with a housing (not shown) of a mating connector and, in use, it is fixed to an outer peripheral surface of a cylindrical member such as a corrugated tube or a corrugated pipe. The joint connector includes a joint terminal to be connected in common to multiple terminals stored in the housing of the mating connector with which the joint connector is engaged, and has a function to short-circuit the multiple terminals of the mating connector with which the joint connector is engaged. Here, in a certain type of joint connector, a terminal mounted on the tip of an electric wire is inserted directly into the joint connector not through the above-mentioned mating connector. This invention would be applied to this type of joint connector. Further, this invention would also be applied not only to a joint connector but also to an ordinary connector used to connect together electric wires.

Figure 1:
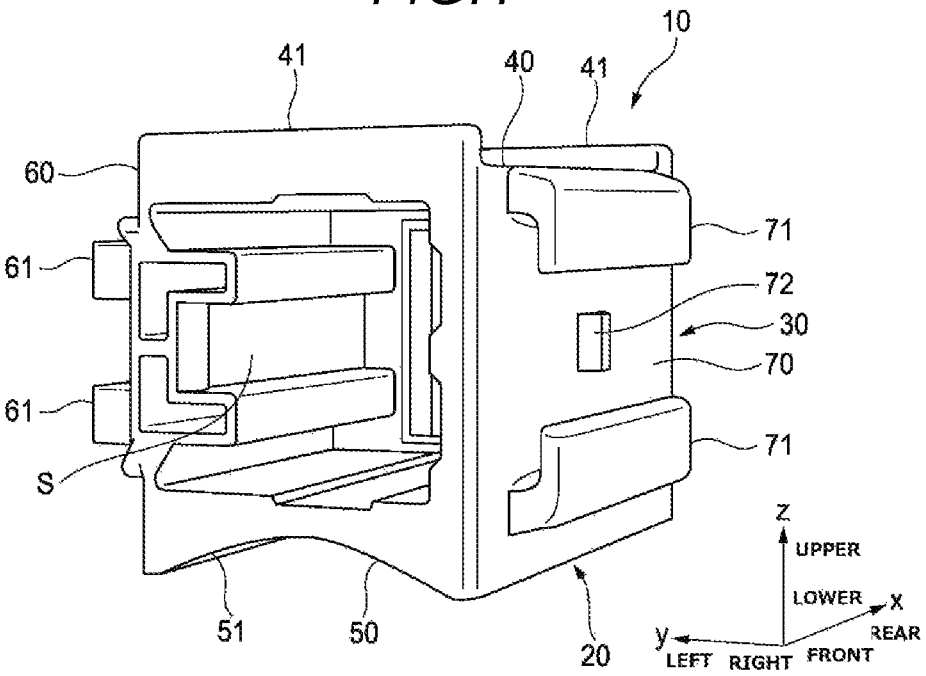
FIG. 1 is a perspective view of a connector housing according to a first embodiment.

Hereinafter, for convenience of explanation, an x axis direction (a front-rear direction), a y axis direction (a left-right direction), a z axis direction (a vertical direction), and front, rear, left, right, upper and lower directions are defined as shown in FIG. 1. The front-rear direction, left-right direction and vertical direction are orthogonal to each other.

Figure 2:
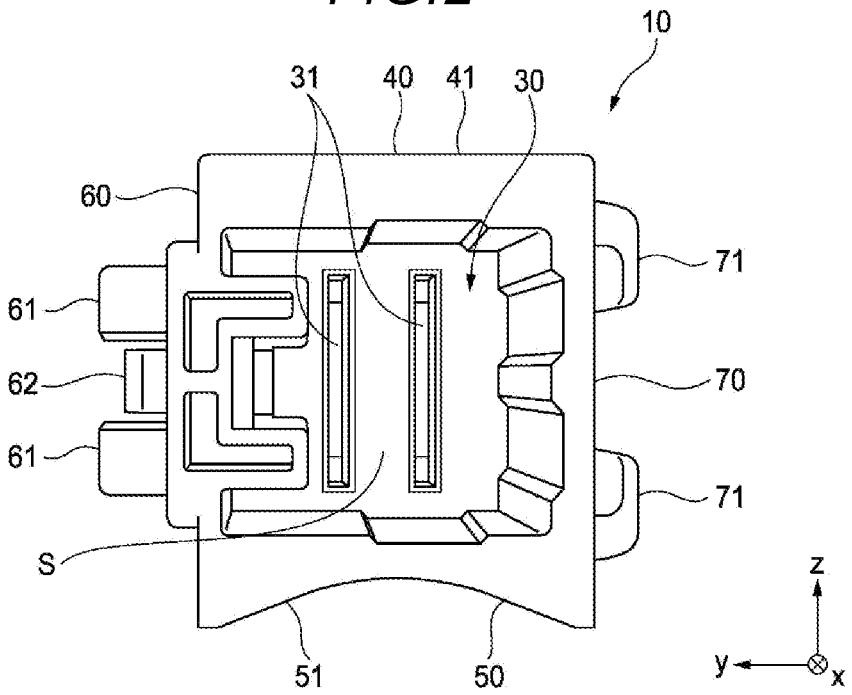
FIG. 2 is a front view of the connector housing shown in FIG. 1.
Figure 3:
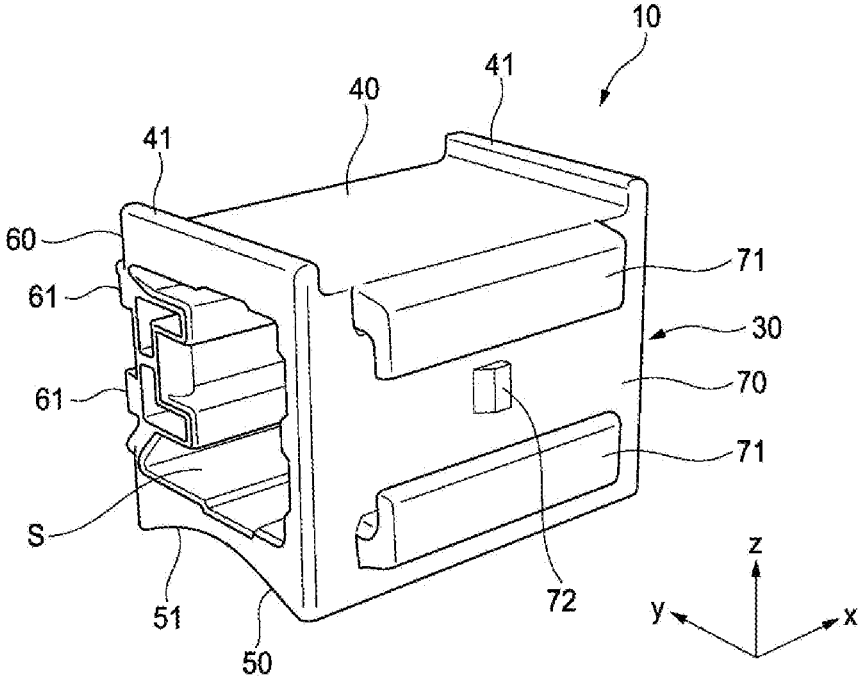
FIG. 3 is a perspective view of the connector housing shown in FIG. 1, when viewed from above.

As shown in FIGS. 1 to 3, the connector housing 10 has a box-like shape which includes a square cylindrical side wall 20 extending in the front-rear direction and a rear wall 30 connected to the side wall 20 so as to close the rear-side end of the side wall 20 and also has an internal space S. When inserted into the internal space S through an opening formed in the front-side end of the side wall 20, the mating connector housing is engaged with the connector housing 10.

The side wall 20 includes an upper wall 40, a lower wall 50, a left wall 60 and a right wall 70. As shown in FIG. 3, on the outer peripheral surfaces (outer surfaces) of the front-rear direction two ends of the upper wall 40, there are formed a pair of parallel ribs 41. The paired ribs 41 project upward and extend in the left-right direction over the whole area of the upper wall 40 in the left-right direction. As described later, the paired ribs 41 perform a function to suppress the displacement of tape T used to fix the connector housing 10 to a cylindrical corrugated tube C (which is also called a cylindrical member) (see FIG. 5B to be described later).

The lower wall 50 includes on its outer peripheral surface (outer surface) a concave surface 51 which is concaved in an arc shape and extends in the front-rear direction over the whole area in the front-rear direction of the lower wall 50. In this embodiment, the concave surface 51 is configured of an arc portion having a single radius of curvature. As described later, the concave surface 51 provides a surface to make contact with the outer peripheral surface of the corrugated tube C in order to fix the connector housing 10 to the corrugated tube C (see FIG. 5A to be described later). Thus, preferably, the radius of curvature of the arc portion of the concave surface 51 may be designed to be equal to the outside diameter of the corrugated tube C which makes contact with the concave surface 51.

The left wall 60 has on its outer peripheral surface (outer surface) a pair of male-side through locks 61 extending in the front-rear direction, while the right wall 70 has on its outer peripheral surface (outer surface) a pair of female-side through locks 71 extending in the front-rear direction. The paired male-side through locks 61 and female-side through locks 71 are engaged with each other.

Therefore, in a state where the paired male-side through locks 61 of one connector housing 10 and the paired female-side through locks 71 of the other connector housing 10 are arranged so as to face each other, when the paired male-side through locks 61 are engaged with the paired female-side through locks 71, the two connector housings 10 are connected and fixed to each other.

In a state where the two connector housings 10 are connected and fixed together, a lock beak 62 (see FIG. 2, particularly) formed between the paired male-side through locks 61 is engaged with a projection 72 (see FIG. 3, particularly) formed between the paired female-side through locks 71, thereby preventing the paired male-side through locks 61 from coming out (separating) from the paired female-side through locks 71.

The rear wall 30, as shown in FIG. 2 particularly, includes a pair of slits 31 extending in the vertical direction. The above-mentioned joint terminal (not shown) is inserted into and fixed to the paired slits 31. Such provision of the joint terminal in the connector housing 10, as described above, enables the connector housing 10 to function as the housing of the joint connector.

Figure 4:
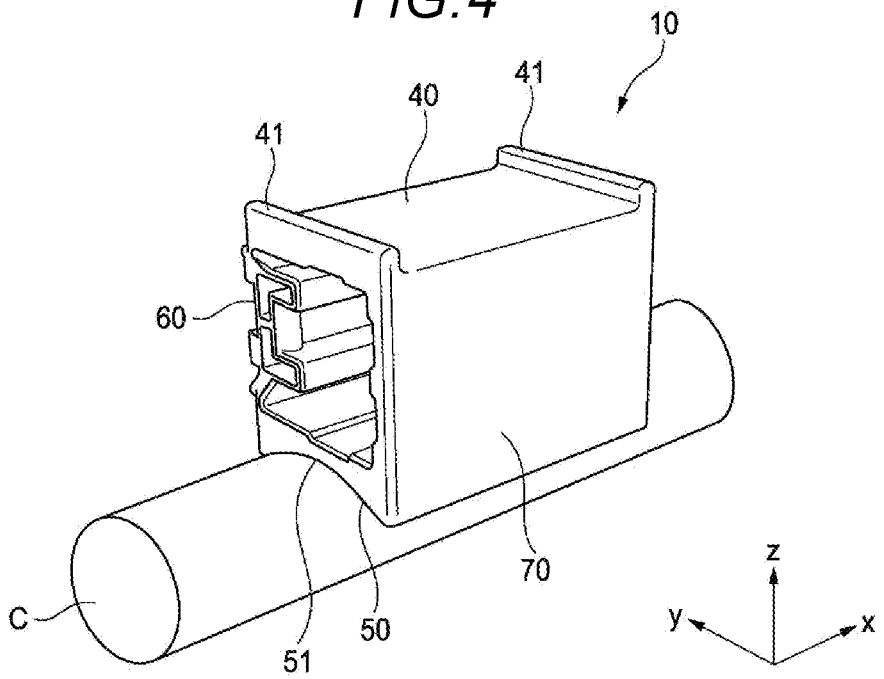
FIG. 4 is a perspective view of the connector housing shown in FIG. 1, showing a state where a concave surface thereof is pressed against a corrugated tube.

As shown in FIGS. 4 and 5, in use, the connector housing 10 is fixed to the outer peripheral surface of a corrugated tube C. Description is given below of a procedure for fixing the connector housing 10 to the outer peripheral surface of the corrugated tube C.

Figure 5A:
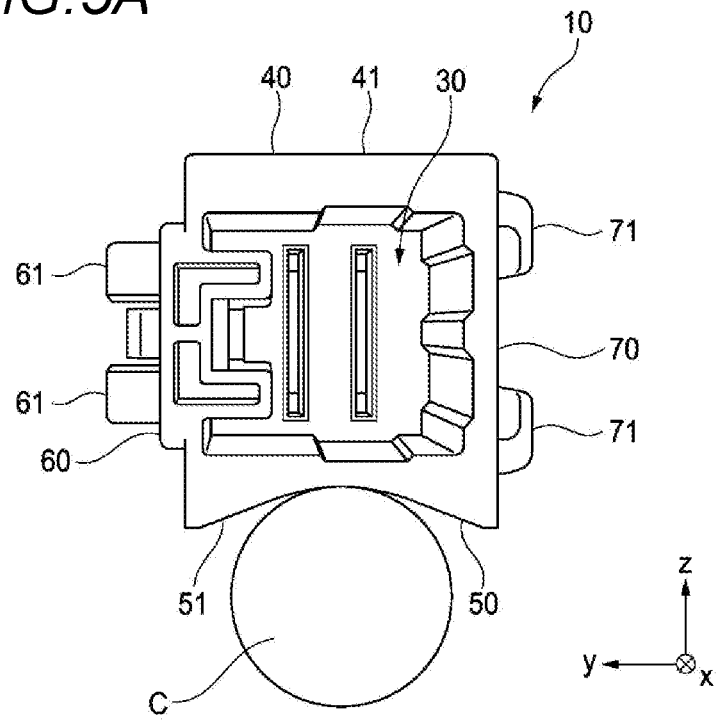
FIG. 5A is a front view of the state shown in FIG. 4.

As shown in FIGS. 4 and 5A, firstly, the connector housing 10 is arranged at a predetermined position in the extending direction of the corrugated tube C where the connector housing 10 must be fixed in such a manner that the front-rear direction of the connector housing 10 extends along the extending direction of the corrugated tube C, and the concave surface 51 of the lower wall 50 of the connector housing 10 is pressed against the corrugated tube C.

Thus, the connector housing 10 are maintain a proper posture with respect to the corrugated tube C, that is, a posture in which the connector housing 10 has no bias with respect to the axis of the corrugated tube C. Also, even when the extending direction of the corrugated tube C is somehow shifted from the front-rear direction of the connector housing 10 locally or wholly before the connector housing 10 is pressed, there would be obtained a state where such portion of the corrugated tube C as is pressed against the concave surface 51 extends straight in the front-rear direction of the connector housing 10.

Figure 5B:
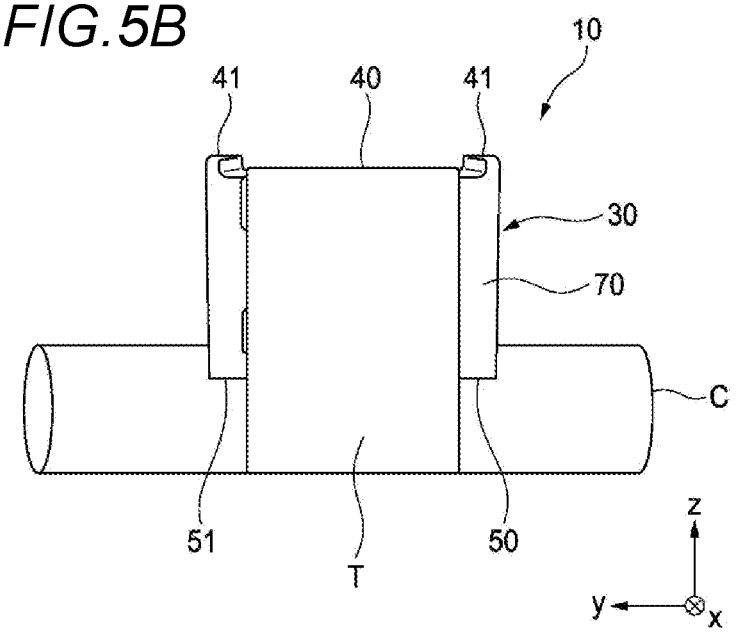
FIG. 5B is a side view, showing a state where the connector housing shown in FIG. 1 is fixed to the corrugated tube using tape.
Figure 6:
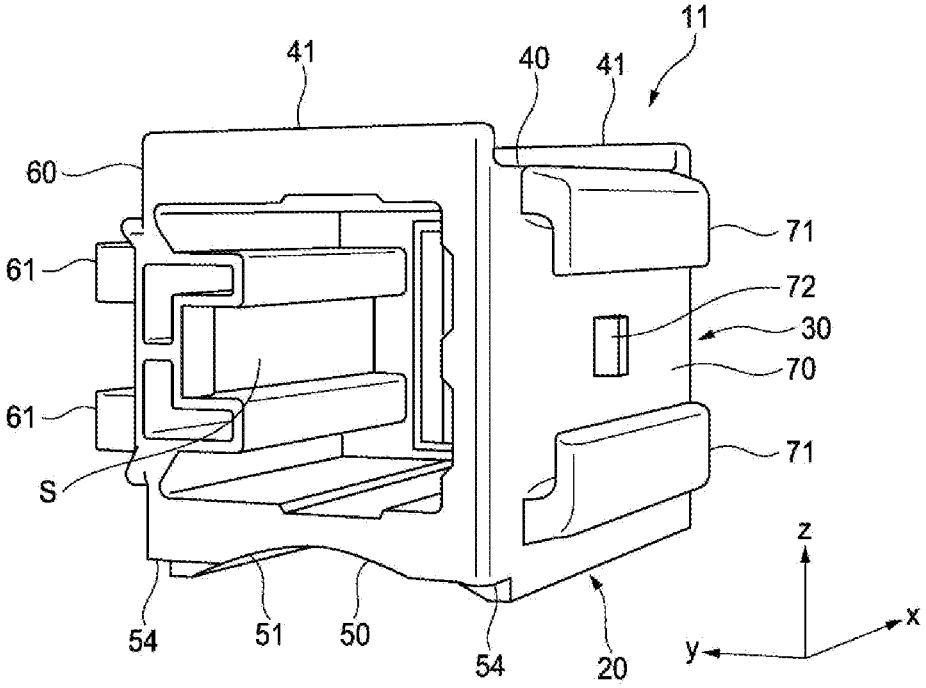
FIG. 6 is a perspective view of a connector housing according to a second embodiment.
Figure 7:
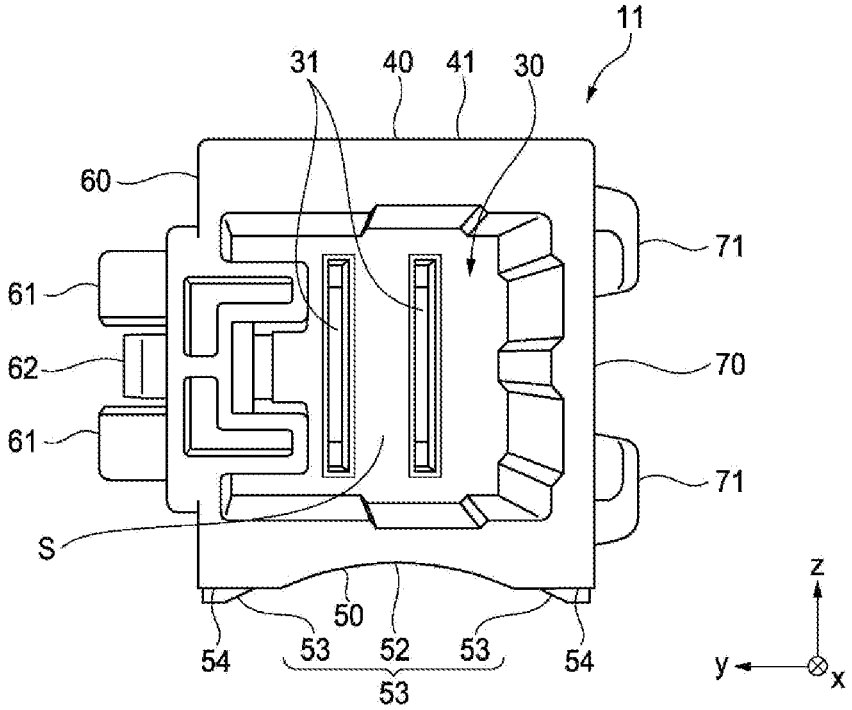
FIG. 7 is a front view of the connector housing shown in FIG. 6.

Next, while maintaining the pressing of the corrugated tube C by the concave surface 51, as shown in FIG. 5B, the tape T is wound so as to collectively cover the outer peripheral surface of the corrugated tube C and the outer peripheral surface of the side wall 20 of the connector housing 10. In this case, the tape T is wound so as to pass through an area intervening between the paired ribs 41 provided on the upper wall 40.

Consequently, in a proper posture where the front-rear direction of the connector housing 10 coincides with the extending direction of the corrugated tube C, the connector housing 10 would be easily fixed to the outer peripheral surface of the corrugated tube C. Also, in winding, the tape T would be easily wound with the paired ribs 41 as a reference. Further, as shown in FIG. 5B, the tape T is wound in such a manner that the end face of the tape T in the width direction is situated near the ribs 41 (or, the end face of the tape T in the width direction is brought into contact with the ribs 41), thereby preventing the tape T against displacement in the width direction (in the front-rear direction of the connector housing 10).

As described above, according to the connector housing 10 of the first embodiment, the concave surface 51 is formed in the outer peripheral surface of the lower wall 50. Thus, even when the connector housing 10 is arranged on the outer peripheral surface of the corrugated tube C, by pressing the connector housing 10 against the corrugated tube C while making one direction of the concave surface 51 extend along the extending direction of the corrugated tube C, the connector housing 10 would maintain a proper posture with respect to the corrugated tube C. Also, by pressing the concave surface 51 against the corrugated tube C, it is easily possible to obtain a state where such portion of the corrugated tube C as is pressed against the concave surface 51 extends straight in the front-rear direction of the connector housing 10. In this state, by winding the tape T so as to collectively cover the outer peripheral surface of the corrugated tube C and the outer peripheral surface of the side wall 20 of the connector housing 10, the connector housing 10 would be easily fixed to the outer peripheral surface of the corrugated tube C in a proper posture where the front-rear direction of the connector housing 10 coincides with the extending direction of the corrugated tube C.

Also, the paired ribs 41 are formed on the upper wall 40. Therefore, in winding, the tape T would be wound easily with the paired ribs 41 as a reference and displacement of the tape T in the width direction (in the front-rear direction of the connector housing 10) would be suppressed.

Second Embodiment

Next, description is given below of a connector housing 11 according to a second embodiment with reference to FIGS. 6 to 13. The connector housing 11 is different from the connector housing 10 according to the above-mentioned first embodiment in that the concave surface 51 of the lower wall 50 includes multiple kinds of arc portions having different radii of curvature and also has notches 54 in the four corner portions thereof. Description is given below of the above different points specifically.

Figure 8A:
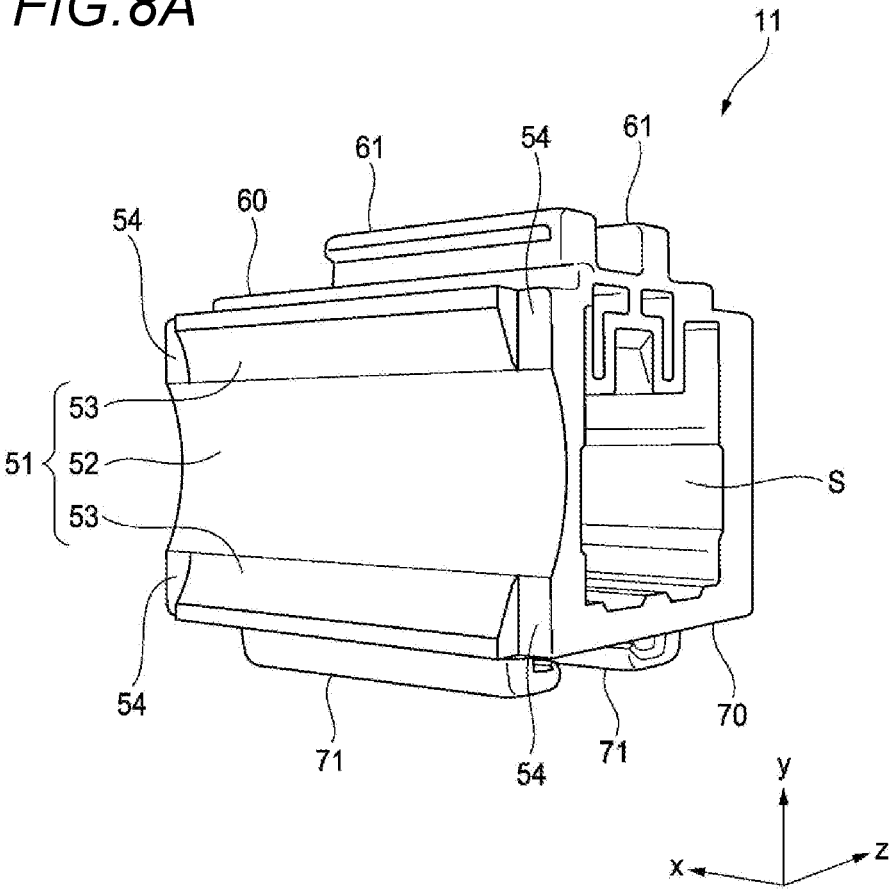
FIG. 8A is a perspective view of the connector housing shown in FIG. 6 when viewed from below.
Figure 8B:
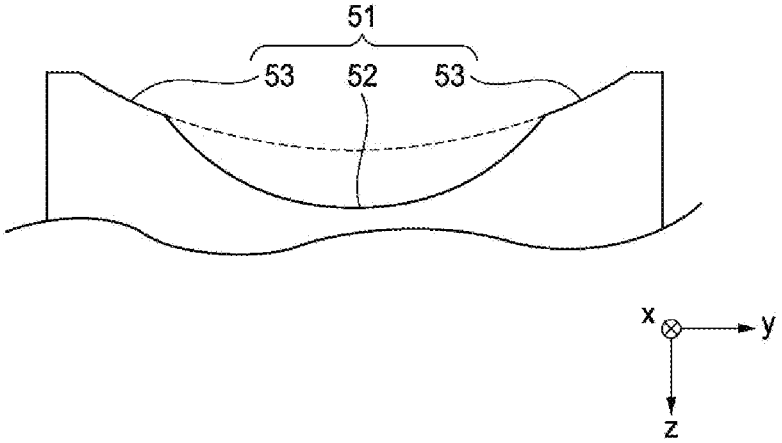
FIG. 8B is an explanatory view of the detailed shape of a concave surface.

Particularly, as can be understood from FIGS. 8A and 8B, the concave surface 51 of the lower wall 50 of the connector housing 11 includes an arc portion 52 (which is called also a first arc portion) extending in the front-rear direction in the right-and-left direction part thereof and having a relatively small radius of curvature, and a pair of left and right arc portions 53 (which are called also second arc portions) extending in the front-rear direction in the right-and-left direction two outside parts thereof and each having a relatively large radius of curvature. The arc portion 52 and arc portions 53 are formed such that the outer peripheral surfaces thereof continue with each other.

Thus, even when the connector housing 11 must be fixed to two kinds of corrugated tubes C having different outside diameters respectively, the connector housing 11 would be fixed in a proper posture with respect to these two kinds of corrugated tubes C. Specifically, when the connector housing 11 is fixed to a corrugated tube C having a relatively small outside diameter equivalent to the radius of curvature of the arc portion 52, the outer peripheral surface of the corrugated tube C comes into contact with the arc portion 52 of the concave surface 51. On the other hand, when the connector housing 11 is fixed to a corrugated tube C having a relatively large outside diameter equivalent to the radius of curvature of the arc portion 53, the outer peripheral surface of the corrugated tube C comes into contact with the paired left and right arc portions 53 of the concave surface 51.

Also, as can be understood from FIG. 8A, in the four corner portions of the concave surface 51 of the lower wall 50 of the connector housing 11, there are formed notches 54 respectively which are formed by cutting the front-rear direction two ends of the arc portions 53. The bottom surface of each notch 54 constitutes a part of one common plane extending in parallel to the front-rear direction and left-right direction (in parallel to the x-y plane).

Figure 9:
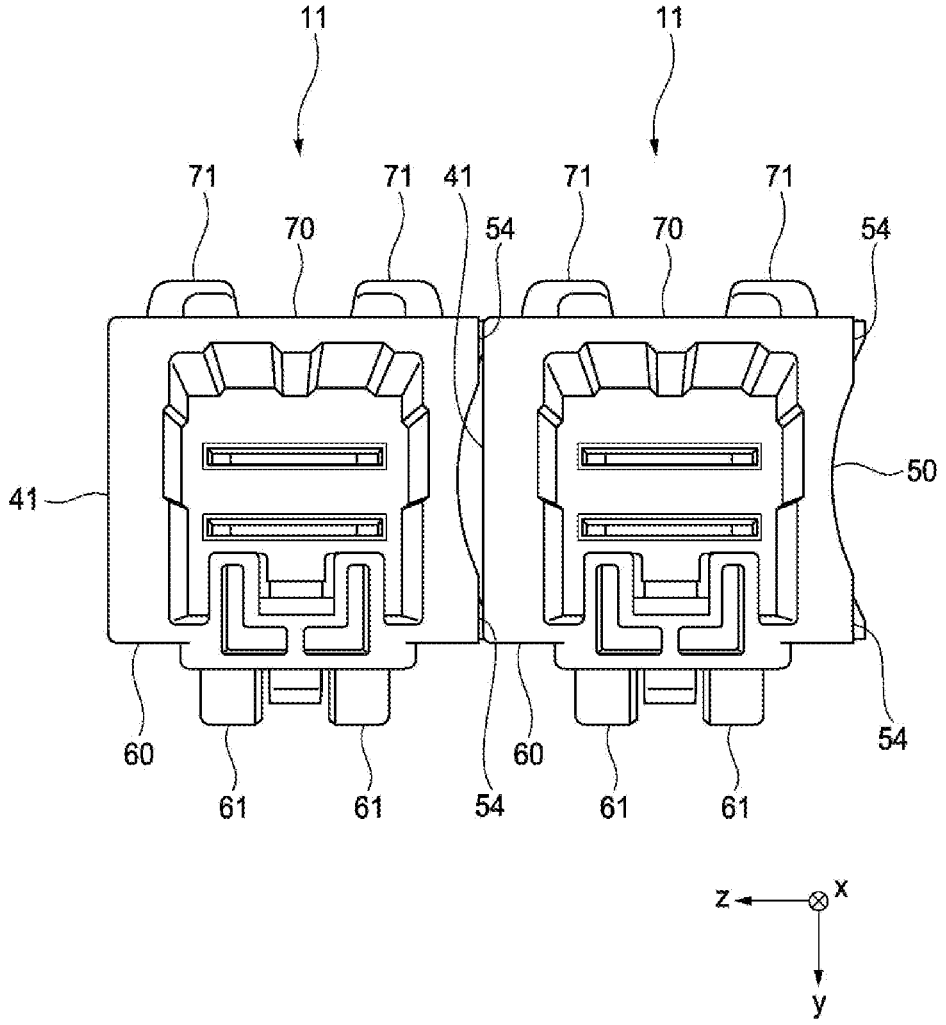
FIG. 9 is a front view of two connector housings shown in FIG. 6, showing a state where they are arranged in the same direction in such a manner that one connector housing enters a notch formed in the concave surface of the other connector housing.

As shown in FIG. 9, when the two connector housings 11 are arranged in the same direction such that the concave surface 51 of one connector housing 11 and the rib 41 of the other connector housing 11 face each other, the respective notches 54 are formed at positions where the ends of their associated ribs 41 can advance therein.

Therefore, as shown in FIG. 9, when the multiple connector housings 11 are arranged and assembled in a line in the same direction such that the rib 41 of one of the adjoining connector housings 11 is allowed to advance into the notch 54 of the concave surface 51 of the other connector housing, the assembly height (in FIG. 9, the left-right direction dimension) would be reduced when compared with a case where such notches 54 are not formed. Thus, when the multiple connector housings 11 are assembled to a vehicle body or an electric connection box in a state where they are arranged and assembled in a line in the same direction, it is possible to reduce a space which is occupied by the whole of the multiple connector housings 11.

Figure 10A:
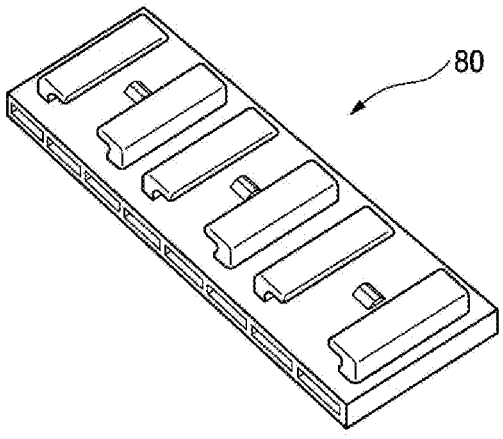
FIG. 10A is a perspective view of a connecting plate.
Figure 10B:
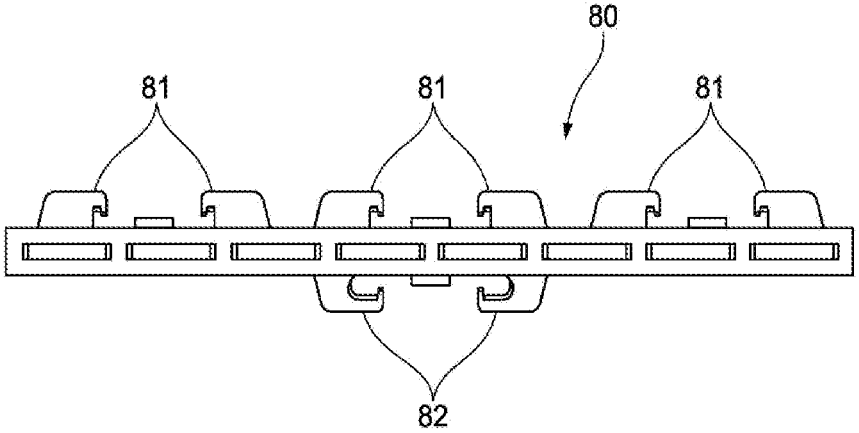
FIG. 10B is a front view of the connecting plate.
Figure 11:
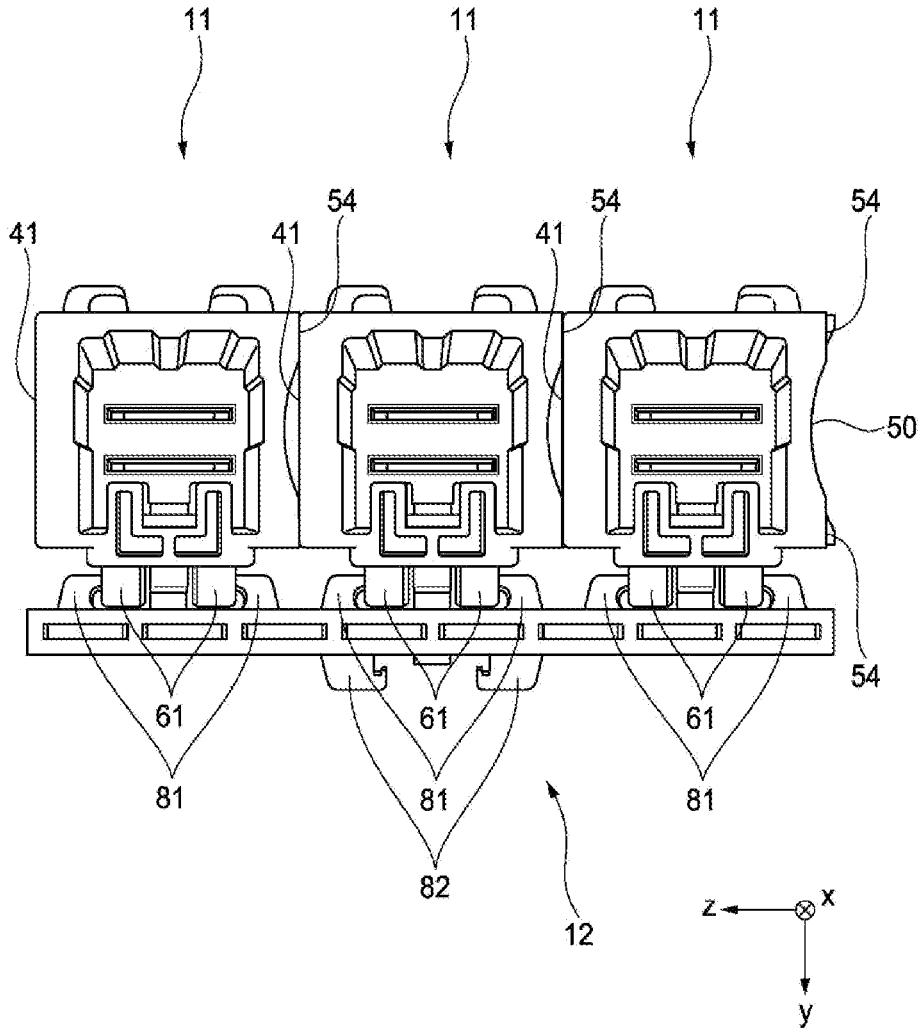
FIG. 11 is a front view of a connected connector housing in which multiple connector housings shown in FIG. 6 are fixed by the connecting plate.

As shown in FIG. 9, by using a connecting plate 80 shown in FIG. 10, the multiple connector housings 11 assembled and arranged in a line in the same direction, as shown in FIG. 11, would be produced as a connected connector housing 12 in which the respective connector housings are connected to each other (which is also called a connector unit).

As shown in FIG. 10, the connecting plate 80 is a resin-made plate-shaped member having a longitudinal direction. The connecting plate 80 includes on one side surface thereof a pair of through locks 81 having the same shape as the paired female-side through locks (see FIG. 7 etc.) in such a manner that they are arranged in a line in multiple portions (in this embodiment, in three portions) spaced from each other by an equal distance in the longitudinal direction. On the other side surface of the connecting plate 80, in the longitudinal-direction central part thereof, there are formed a pair of through locks 82 having the same or similar shape to the paired through locks 81.

As shown in FIG. 11, when the paired male-side through locks 61 of the respective connector housings 11 are engaged with the corresponding paired through locks 81 of the connecting plate 80 in a state where the multiple connector housings 11 are assembled and arranged in a line in the same direction as shown in FIG. 9, there is obtained the connected connector housing 12. Here, the paired through locks 82 of the connecting plate 80 would be used, for example, when assembling the connected connector housing 12 to a vehicle body or an electrical junction box.

Figure 12A:
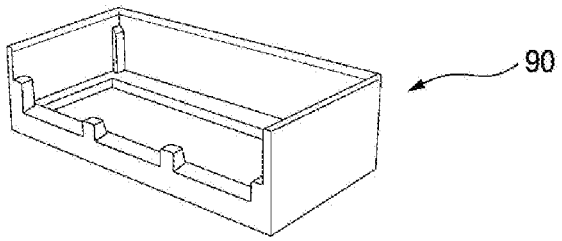
FIGS. 12A, 12B and 12C are views of the first half of a procedure when the connected connector housing is assembled using a connecting jig.

When assembling the connected connector housing 12 shown in FIG. 11, as shown in FIGS. 12 and 13, it is convenient to use a connecting jig 90. As shown in FIG. 12A, the connecting jig 90 is a resin-made box-shaped member the top of which is opened and has a longitudinal direction.

Figure 12B:
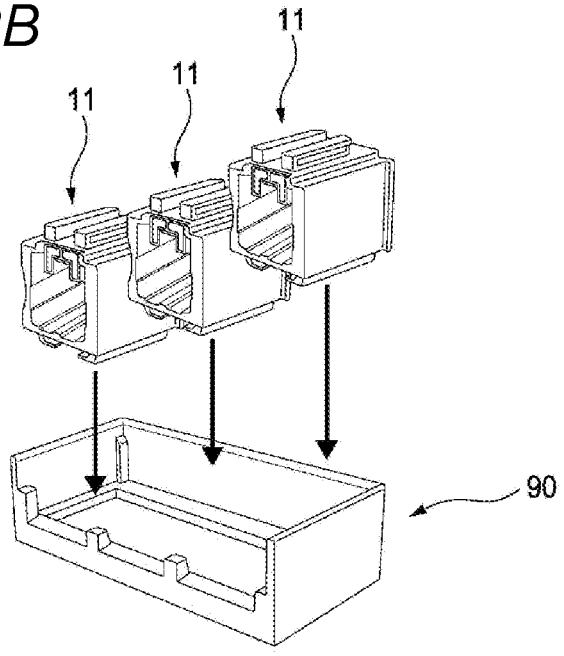
Figure 12C:
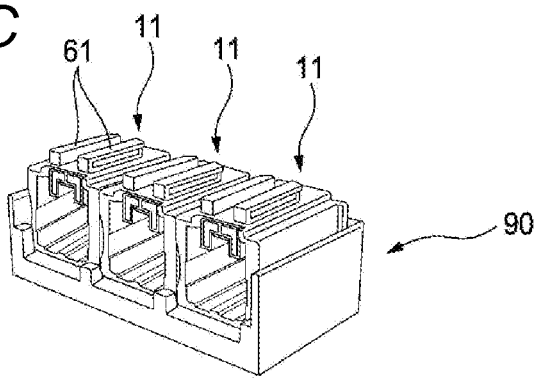

As shown in FIGS. 12B and 12C, the multiple (in this embodiment three) connector housings 11 arranged in a line in the same direction as shown in FIG. 9 are stored into the internal space of the connecting jig 90 in such a manner that their respective paired male-side through locks 61 face upward. Thus, since the side walls of the connecting jig 90 cover the multiple connector housings 11, the multiple connector housings 11 are fixed in such a manner that the respective paired male-side through locks 61 face upward and are prevented against relative movement with respect to each other.

Figure 13A:
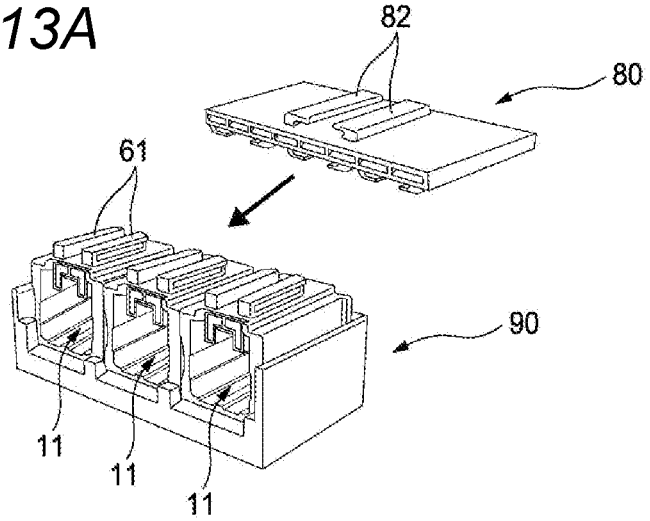
FIGS. 13A, 13B and 13C are views of the second half of the procedure when the connected connector housing is assembled using the connecting jig.
Figure 13B:
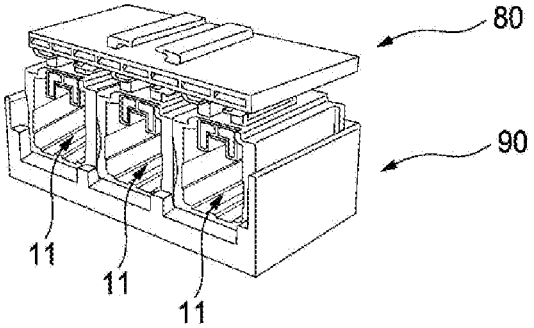
Figure 13C:
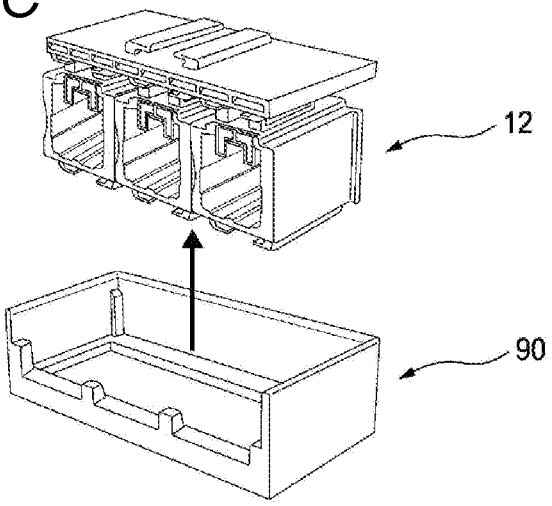

In this state, as shown in FIGS. 13A and 13B, the respective paired through locks 81 of the connecting plate 80 are engaged with the paired male-side through locks 61 of the respective connector housings 11 and, after then, as shown in FIG. 13C, the connecting jig 90 is removed. Consequently, the connected connector housing 12 would be produced easily.

As described above, according to the connector housing 11 of the second embodiment, the concave surface 51 of the lower wall 50 is configured such that it includes the arc portion 52 and arc portions 53 having different radii of curvature. Thus, even when the connector housings 11 must be fixed to the respective multiple kinds of corrugated tubes C having different outside diameters, the connector housings 11 would maintain a proper posture with respect to the respective corrugated tubes C.

Further, in the respective four corner portions of the concave surface 51 of the lower wall 50, there are formed the notches 54 that are formed by cutting out the front-rear direction two ends of the arc portions 53. Thus, when the multiple connector housing 11 are assembled and arranged in a line in the same direction in such a manner that the ribs 41 of one of the adjoining connector housings 11 are allowed to advance into the notches 54 of the concave surface 51 of the other connector housing 11, the assembly height (in FIG. 9, the left-right direction dimension) would be reduced when compared with a case where such notches 54 are not formed.

Third Embodiment

Figure 14:
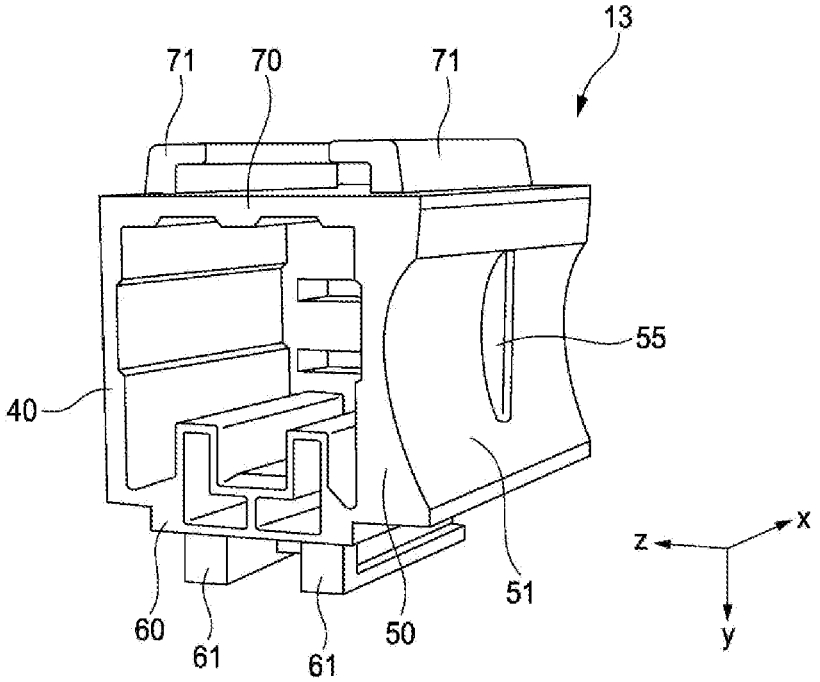
FIG. 14 is a perspective view of a connector housing according to a third embodiment.
Figure 15:
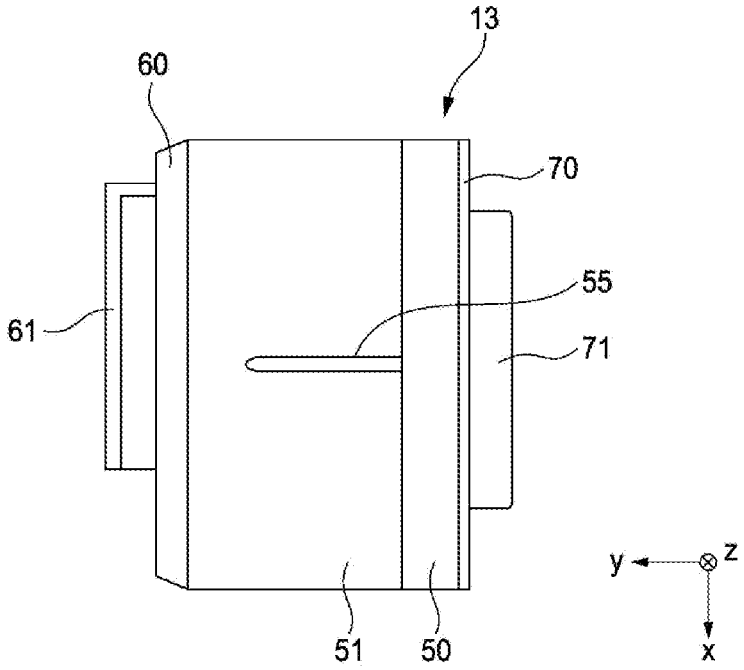
FIG. 15 is a bottom view of the connector housing according to the third embodiment.
Figure 16:
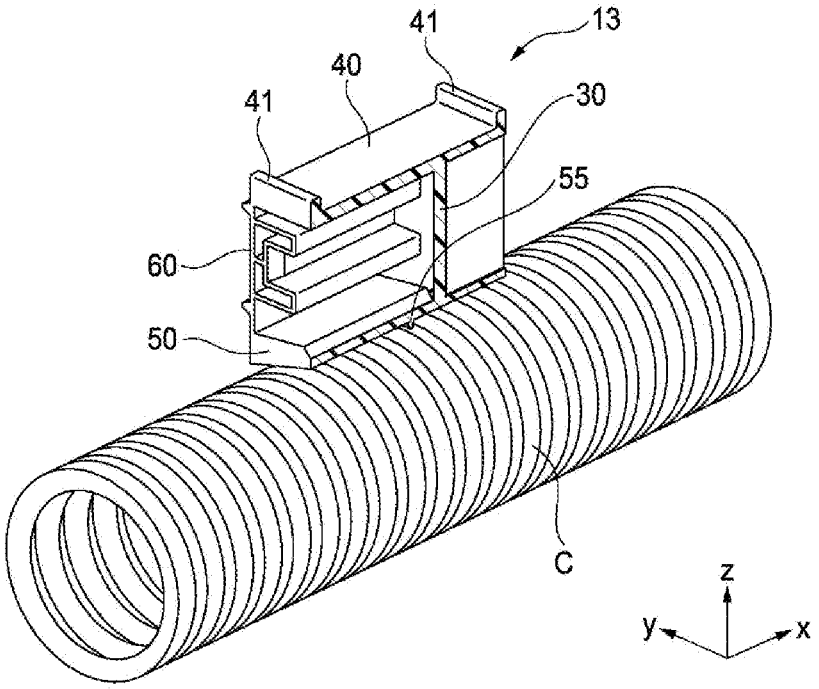
FIG. 16 is a perspective view of the connector housing shown in FIG. 14 when viewed in its longitudinal section passing through an engagement projection, showing a state where a concave surface of the connector housing is pressed against a corrugated tube.
Figure 17:
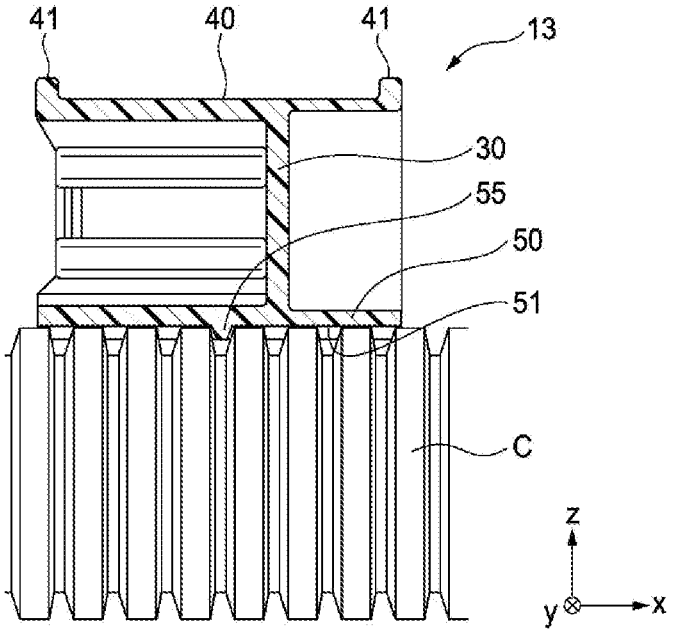
FIG. 17 is a side view of the connector housing shown in FIG. 14 when viewed in its longitudinal section passing through an engagement projection, showing a state where the concave surface of the connector housing is pressed against a corrugated tube.

Next, description is given of a connector housing 13 according to a third embodiment with reference to FIGS. 14 to 17. A connector housing 13 is different from the connector housing 10 of the first embodiment and the connector housing 11 of the second embodiment in that an engagement projection 55 is formed on the concave surface 51 of the lower wall 50. Description is given below specifically of the above-mentioned different feature. FIG. 14 is a perfective view of a connector housing according to a third embodiment. FIG. 15 is a bottom view of the connector housing according to the third embodiment. FIG. 16 is a perspective view of the connector housing shown in FIG. 14 when viewed in its longitudinal section passing through the engagement projection, showing a state in which a concave surface of the connector housing is pressed against a corrugated tube. FIG. 17 is a side view of the connector housing shown in FIG. 14 when viewed in its longitudinal section passing through the engagement projection, showing a state in which a concave surface of the connector housing is pressed against a corrugated tube.

The engagement projection 55, as shown in FIGS. 14 and 15, is a projection which projects from the concave surface 51 of the lower wall 50. In the connector housing 13 of the third embodiment, the engagement projection 55 is formed in the substantially central portion of the concave surface 51 in the front-rear direction (x direction). Also, the engagement projection 55 is formed as a ridge extending along the left-right direction (y axis direction). In other words, the engagement projection 55 is formed as a rib which is provided along the peripheral surface of the concave surface 51 concaved in an arc shape. The engagement projection 55, as shown in FIGS. 16 and 17, has a shape which can be engaged with a valley of a corrugated tube C formed in a flexible tube shape. Thus, the projection height of the engagement projection 55 from the concave surface 51 is set to be approximately equal to the distance between a mountain and a valley of the outer surface of the corrugated tube C.

Figure 18:
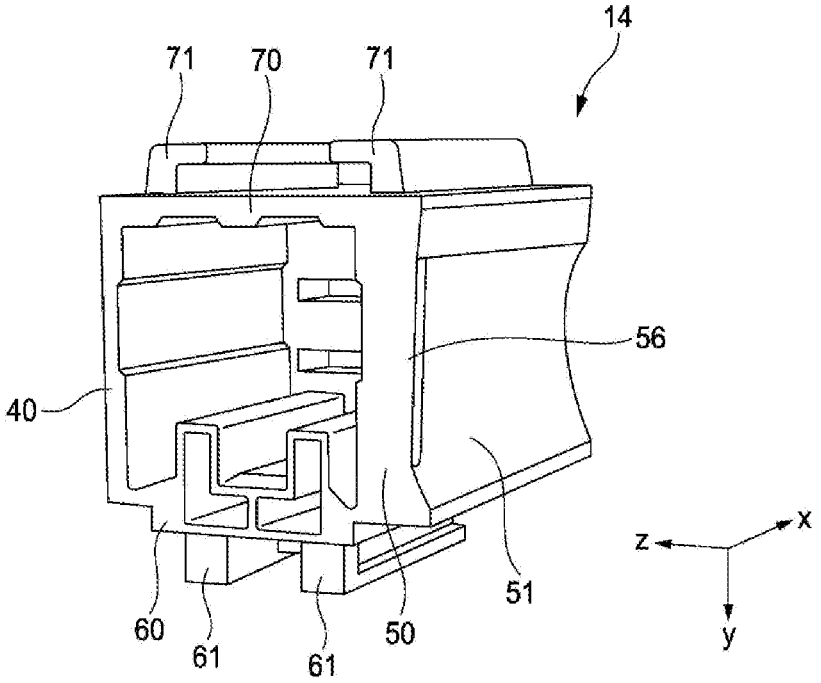
FIG. 18 is a perspective view of a connector housing according to a modification of the third embodiment.
Figure 19:
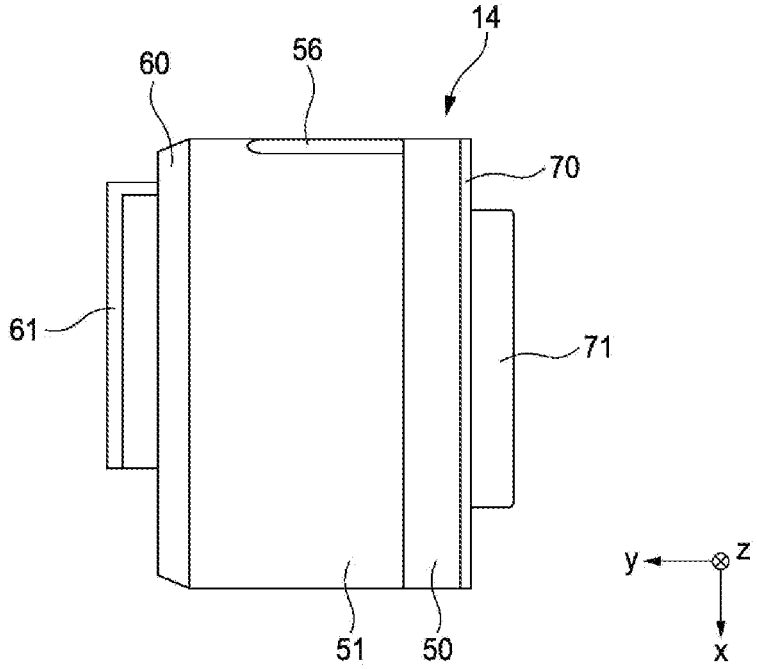
FIG. 19 is a bottom view of the connector housing according to the modification of the third embodiment.
Figure 20:
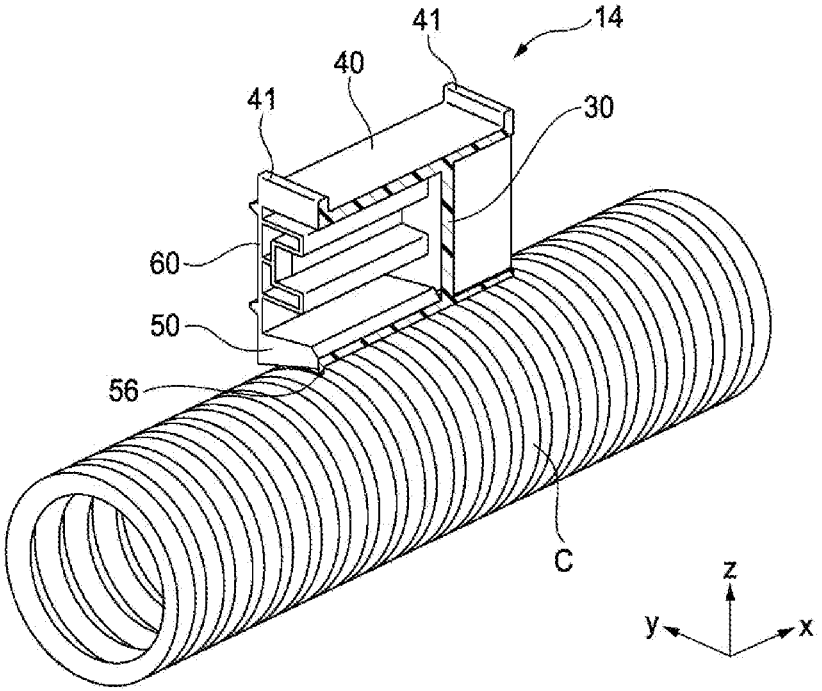
FIG. 20 is a perspective view of the connector housing shown in FIG. 18 when viewed in its longitudinal section passing through an engagement projection, showing a state where a concave surface of the connector housing is pressed against a corrugated tube.
Figure 21:
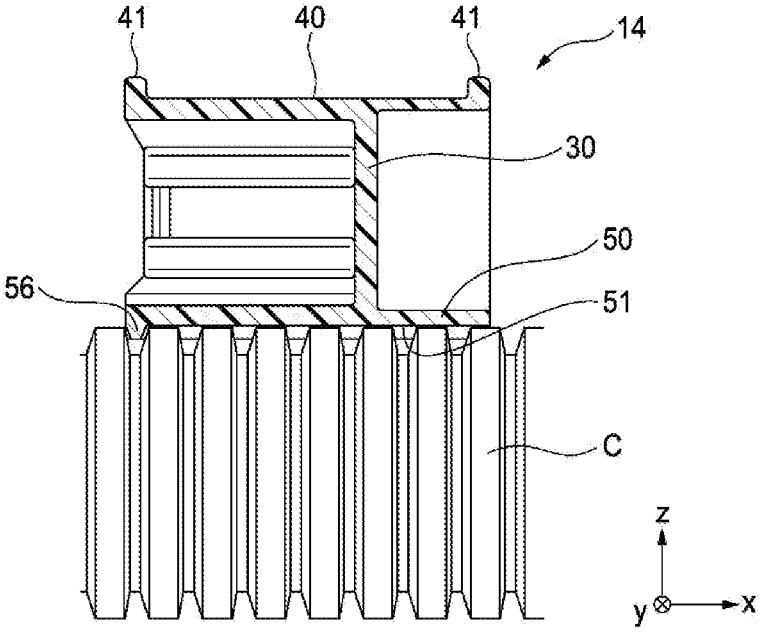
FIG. 21 is a side view of the connector housing shown in FIG. 18 when viewed in its longitudinal section passing through an engagement projection, showing a state where the concave surface of the connector housing is pressed against a corrugated tube.

Next, referring to FIGS. 18 to 21, description is given of a connector housing 14 according to a modification of the third embodiment. FIG. 18 is a perspective view of a connector housing according to the modification of the third embodiment. FIG. 19 is a bottom view of the connector housing according to the modification of the third embodiment. FIG. 20 is a perspective view of the connector housing shown in FIG. 18, when viewed in its longitudinal section passing through an engagement projection, showing a state in which a concave surface of the connector housing is pressed against a corrugated tube. FIG. 21 is a side view of the connector housing shown in FIG. 18 when viewed in its longitudinal section passing through an engagement projection, showing a state in which a concave surface of the connector housing is pressed against a corrugated tube.

In the connector housing 13, the engagement projection 55 is formed in the substantially central portion of the concave surface 51 in the front-rear direction (x direction), whereas, in the connector housing 14, as shown in FIGS. 18 to 21, an engagement projection 56 is formed along the front-side end face of a concave surface 51. The connector housings 13 and 14 are different from each other in the portions thereof where the engagement projections 55 and 56 are formed.

As can be understood from the connector housings 13 and 14, the engagement projections 55 and 56 would provide the below-mentioned operation and effect peculiar to the third embodiment regardless of the front-rear direction (x direction) positions where they are formed in the concave surface 51.

According to the connector housings 13 and 14 of the third embodiment, the engagement projections 55 and 56 are formed in the concave surface 51. Thus, when the connector housings 13 and 14 are arranged on the outer peripheral surface of the corrugated tube C, the engagement projections 55 and 56 are engaged with the valley of the corrugated tube C formed in a flexible tube shape. This enables the connector housings 13 and 14 to be caught in the corrugated tube C. Accordingly, when winding the tape T so as to collectively cover the outer peripheral surface of the corrugated tube C and the outer peripheral surfaces of the side walls 20 of the connector housings 13 and 14, the connector housings 13 and 14 would be prevented from slipping on the outer surface of the corrugated tube C. As a result, an operator would stably wind the tape on the connector housings 13 and 14 fixed to the outer surface of the corrugated tube C.

Also, the engagement projections 55 and 56 are formed as ribs which are provided along the peripheral direction of the arc-like recessed concave surface 51. This structure enables the engagement projections 55 and 56 to secure a sufficient engagement margin with respect to the valley formed along the peripheral direction of the corrugated tube C. This enables more suppression of slipping of the connector housings 13 and 14 on the outer surface of the corrugated tube C.

Here, in the third embodiment, description has been given of an example in which the engagement projection 55 is formed as the rib. However, the engagement projection may have other shape than the rib-like shape. For example, even when it is a conical or cylindrical projection projecting in one location, the engagement projections 55 and 56 would be engaged with the valley of a flexible-tube-like shaped corrugated tube C. In this manner, the shape of the engagement projection would be changed properly according to the degree of engagement to be secured with respect to the valley formed along the peripheral direction of the corrugated tube C.

In the above description, the projection height of the engagement projection from the concave surface 51 is set to be approximately equal to the distance between a mountain and a valley of the outer surface of the corrugated tube C. However, the projection height of the engagement projection may be shorter or longer than the distance between a mountain and a valley of the outer surface of the corrugated tube C. When the projection height of the engagement projection is reduced, the engagement margin to be secured with respect to the valley formed along the peripheral direction of the corrugated tube C becomes shallower; meanwhile, when the projection height of the engagement projection is increased, the engagement margin becomes deeper. In this manner, the engagement force required for the engagement projection would be adjusted according to the size of the projection height of the engagement projection. Here, when the projection height of the engagement projection is set longer than the distance between the mountain and valley of the outer surface of the corrugated tube C, the tip of the engagement projection comes into contact with the corrugated tube C. Even in this case, when some deformation is permitted on the outer surface of the corrugated tube C, such contact provides no obstacle to stable tape winding. Rather, biting of the engagement projection into the outer surface of the corrugated tube C would suppress slipping of the connector housings 13 and 14 on the outer surface of the corrugated tube C. This enables stable tape winding with respect to the connector housings 13 and 14 fixed more firmly to the outer surface of the corrugated tube C.

Here, the structure described in the third embodiment would be applied to the connector housing according to the first or second embodiment. Particularly, the above-mentioned engagement projection would be applied to the concave surface 51 which has been described in the second embodiment and includes the arc portions 52 and 53 having different radii of curvature. In this case, the engagement projections are provided respectively in the arc portions 52 and 53.

Fourth Embodiment

Figure 22A:
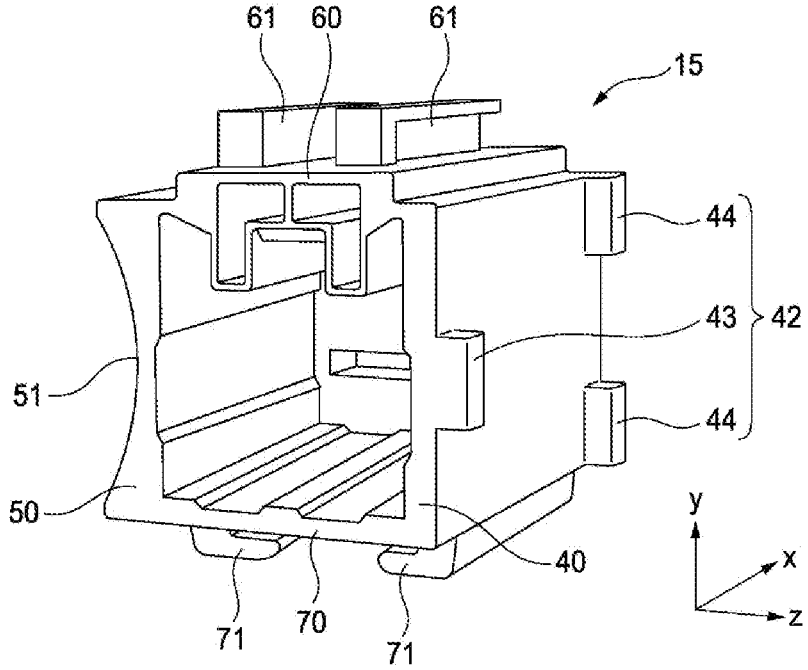
FIGS. 22A and 22B are perspective views of a connector housing according to a fourth embodiment.
Figure 22B:
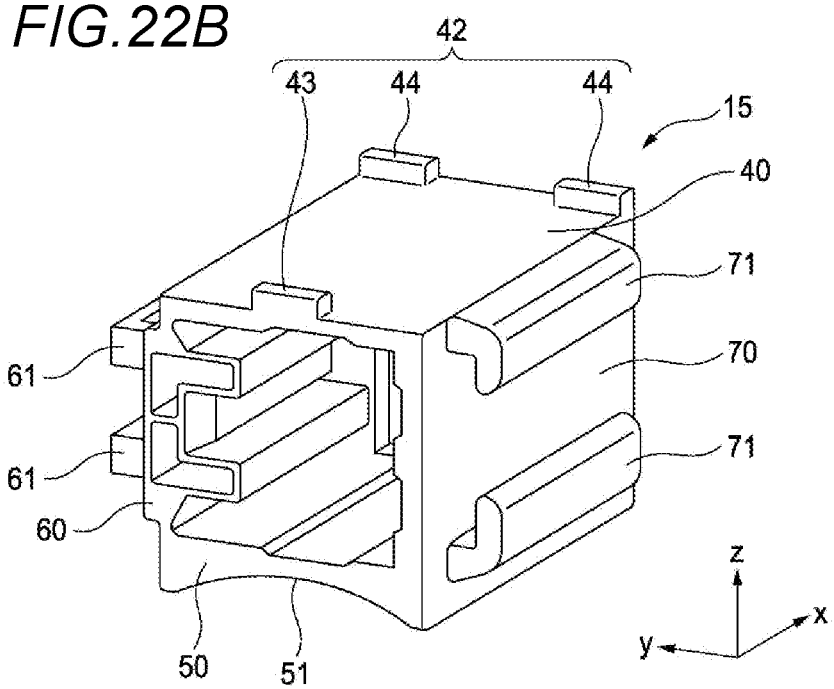

Next, referring to FIG. 22, description is given of a connector housing 15 according to a fourth embodiment. The connector housing 15 is configured such that a rib 42 formed on the outer peripheral surface of an upper wall 40 is different in shape from the rib 41 according to the connector housing 10 of the first embodiment, the connector housing 11 of the second embodiment or the connector housings 13, 14 of the third embodiment. Description is given below specifically of the above-mentioned different feature. FIGS. 22A and 22B are perspective views of the connector housing according to the fourth embodiment.

In the connector housings according to the first to third embodiments, on the outer peripheral surfaces (outer surfaces) of the front-rear direction two ends of the upper wall 40, there are provided the paired parallel ribs 41 so as to face each other. In the connector housing 15 according to the fourth embodiment, the two ribs 42 are formed on the outer peripheral surfaces (outer surfaces) of the front-rear direction two ends of the upper wall 40 in common with the other embodiments, but they are not formed so as to face each other. That is, a front-side rib 43 situated on the front-side end of the upper wall 40 is formed in the left-right direction central portion of the front-side end, while the rear-side end of the upper wall 40 situated rearward of the front-side rib 43 is cut out. Meanwhile, rear-side ribs 44 situated in the rear-side end of the upper wall 40 are formed on the left-right direction two sides of the rear-side end, while such portion of the front-side end of the upper wall 40 as is situated forward of the rear-side rib 44 is cut out. Thus, in the ribs 42, the front-side rib 43 and rear-side rib 44 are alternately arranged in the front-rear two ends of the upper wall 40 so that they do not face each other.

Figure 23A:
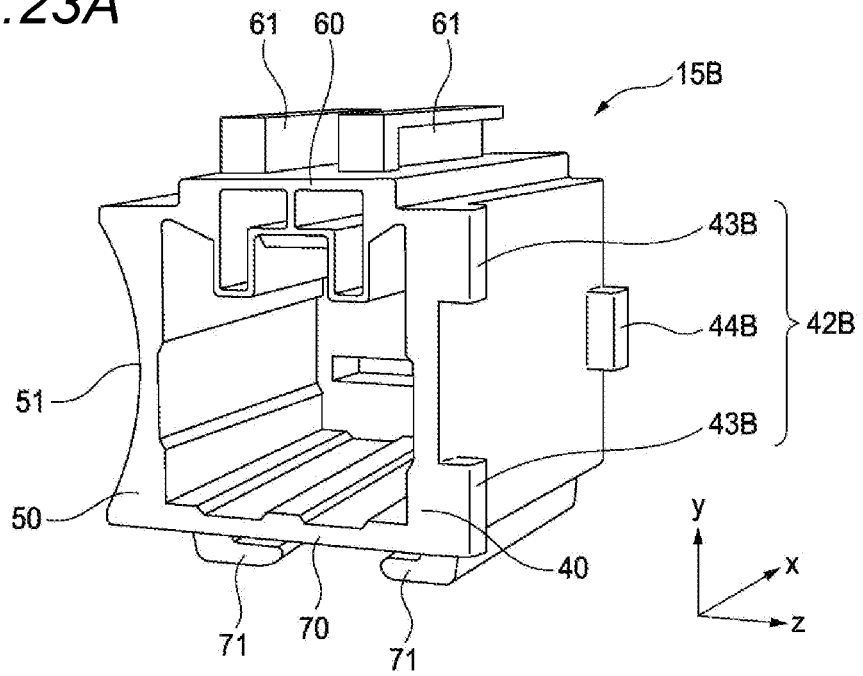
FIGS. 23A and 23B are perspective views of a first modification of the connector housing according to the fourth embodiment.
Figure 23B:
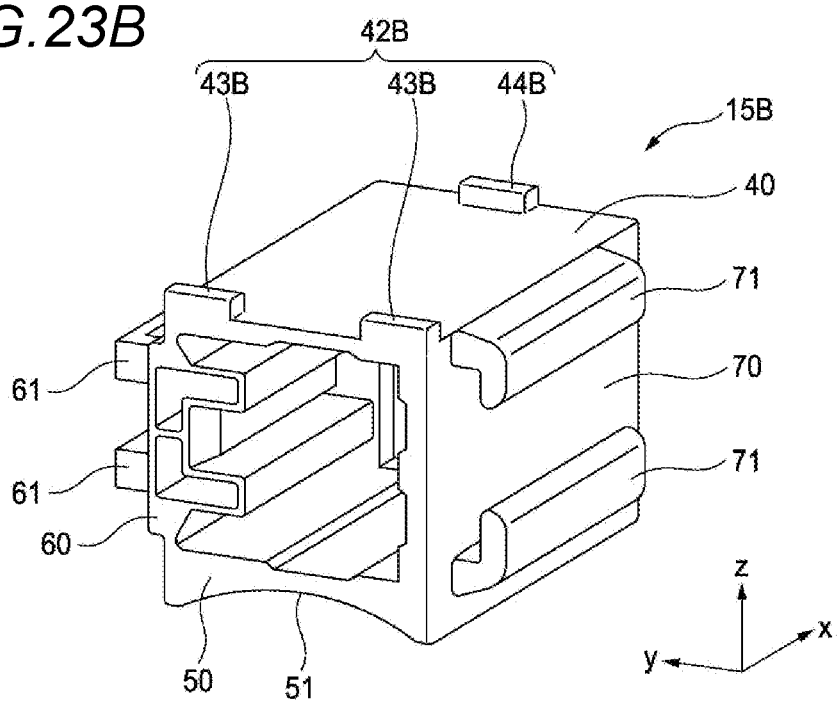
Figure 24A:
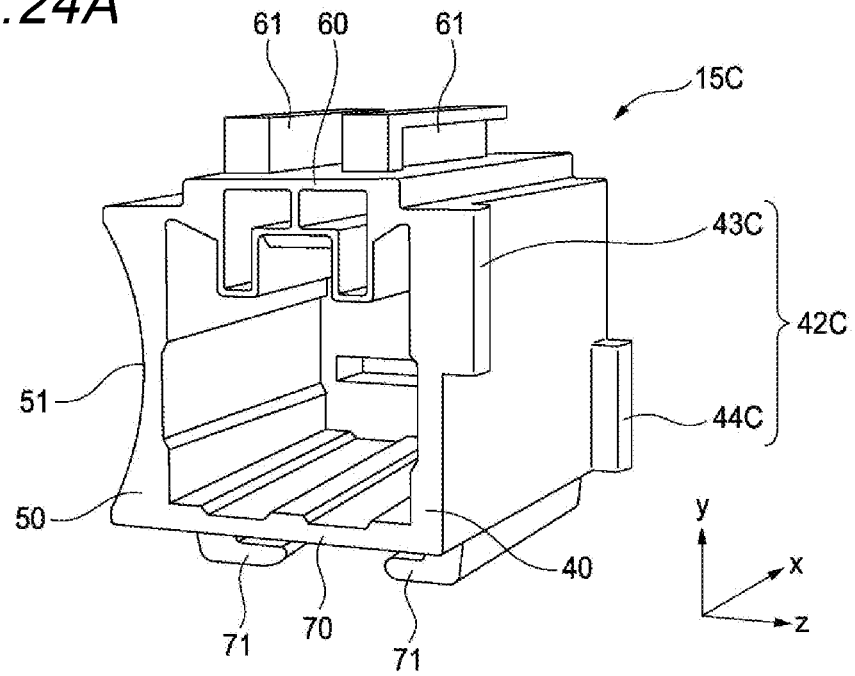
FIGS. 24A and 24B are perspective views of a second modification of the connector housing according to the fourth embodiment.
Figure 24B:
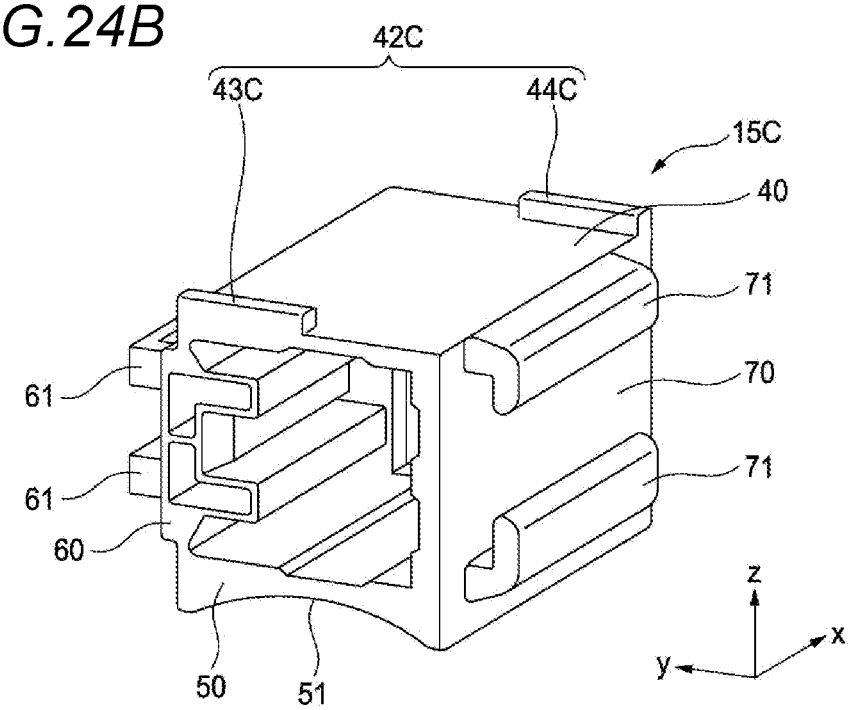
Figure 25A:
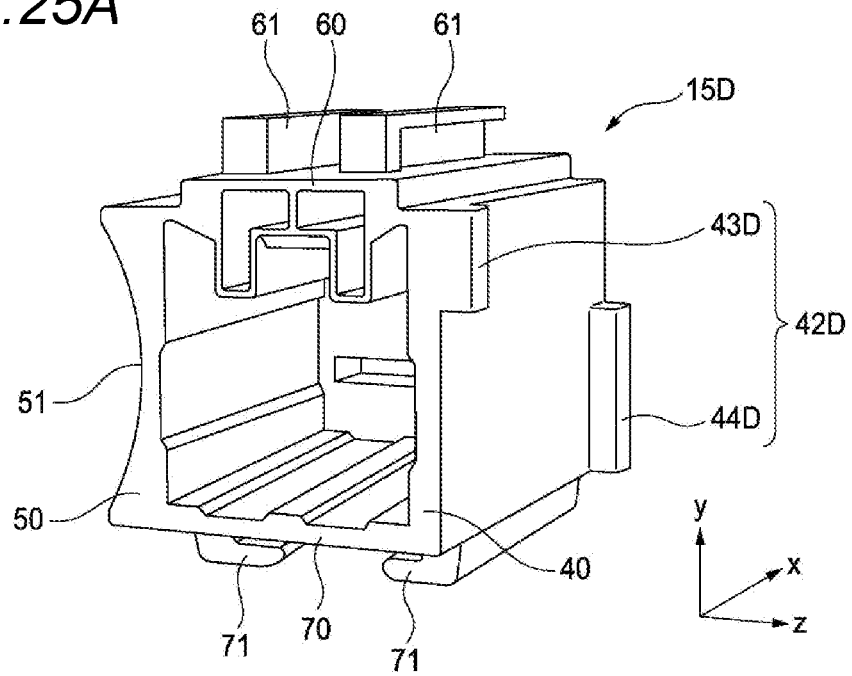
FIGS. 25A and 25B are perspective views of a third modification of the connector housing according to the fourth embodiment.
Figure 25B:
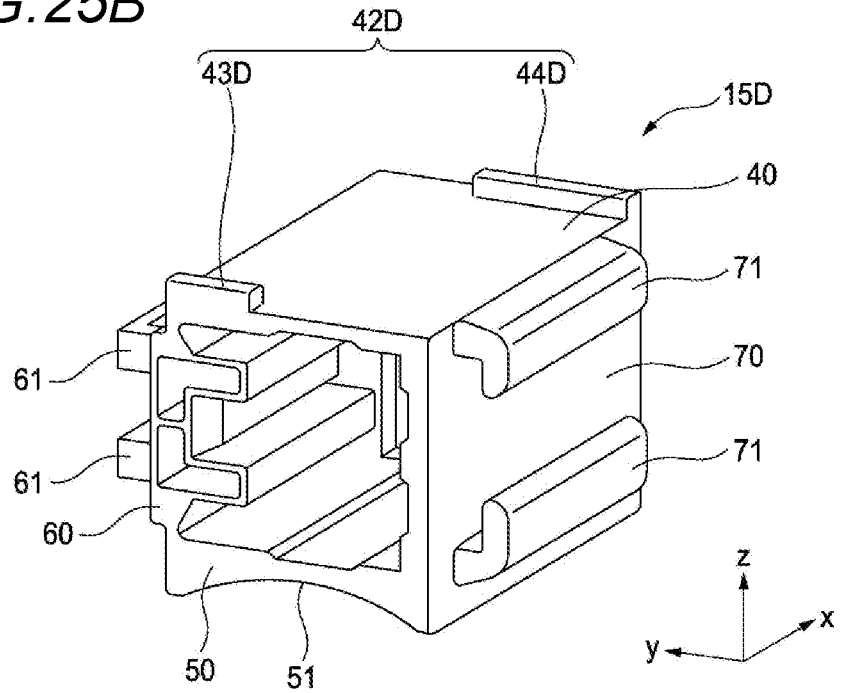
Figure 26A:
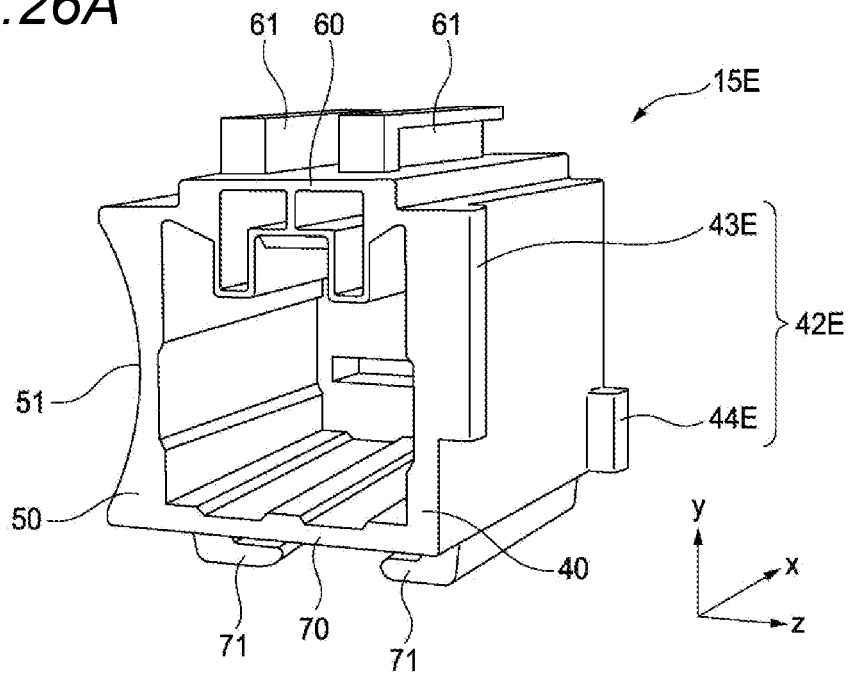
FIGS. 26A and 26B are perspective views of a fourth modification of the connector housing according to the fourth embodiment.
Figure 26B:
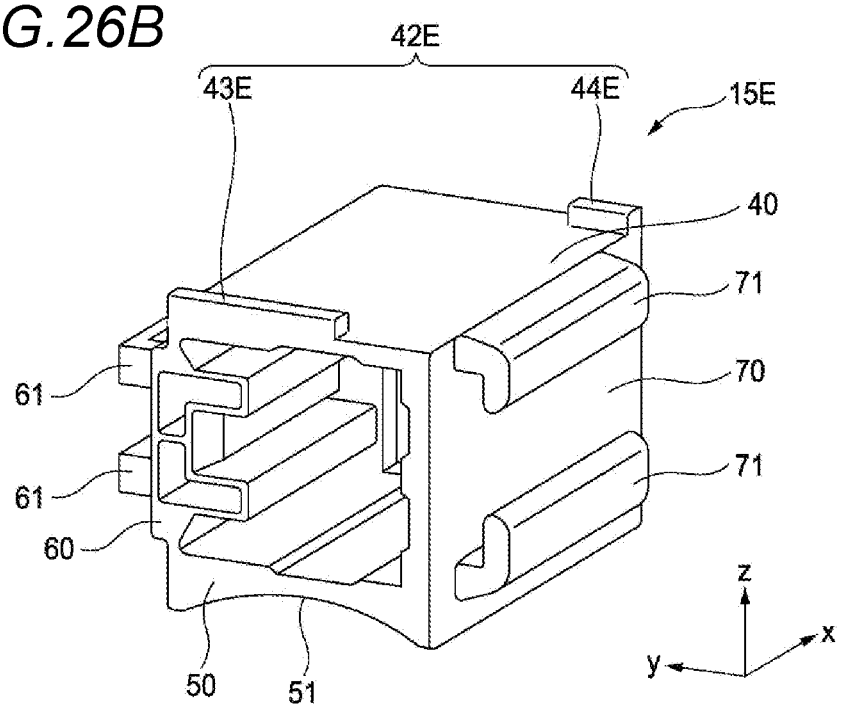
Figure 27A:
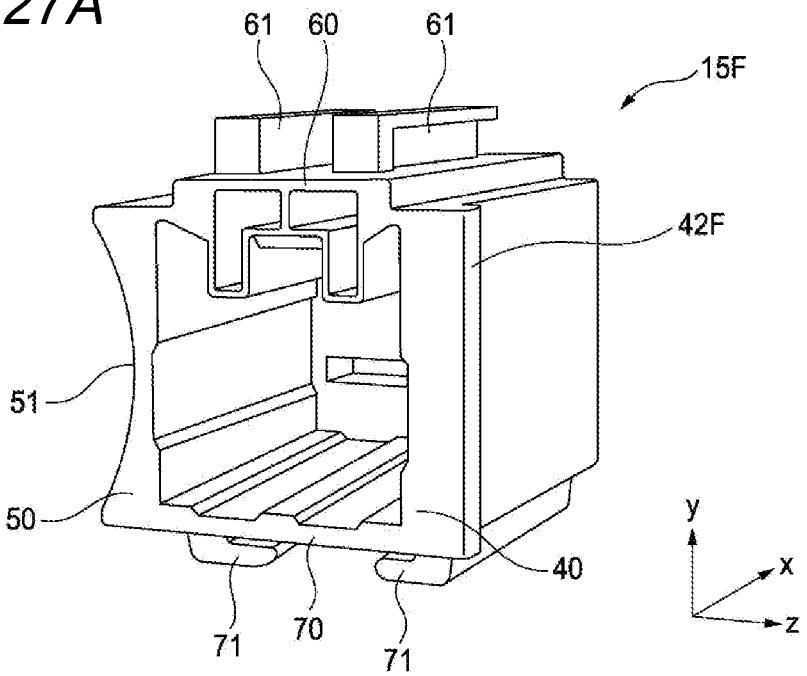
FIGS. 27A and 27B are perspective views of a fifth modification of the connector housing according to the fourth embodiment.
Figure 27B:
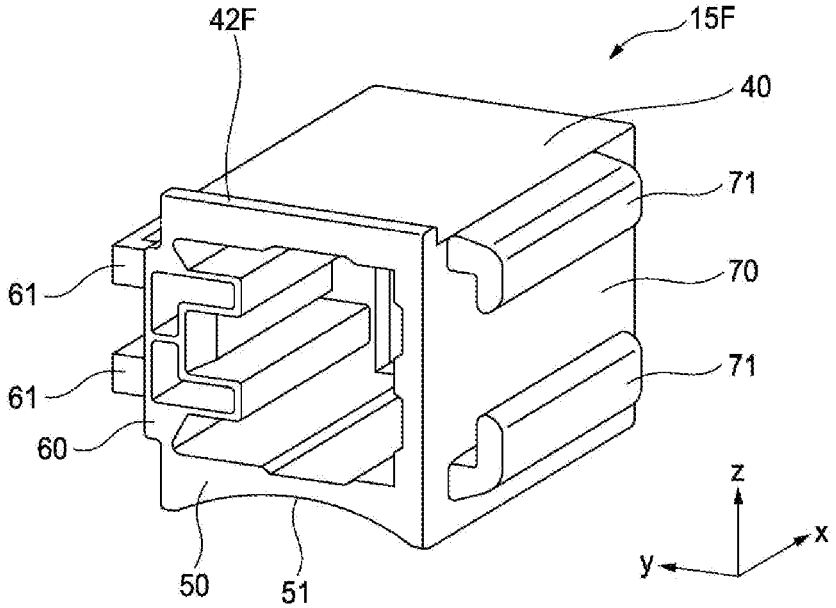
Figure 28A:
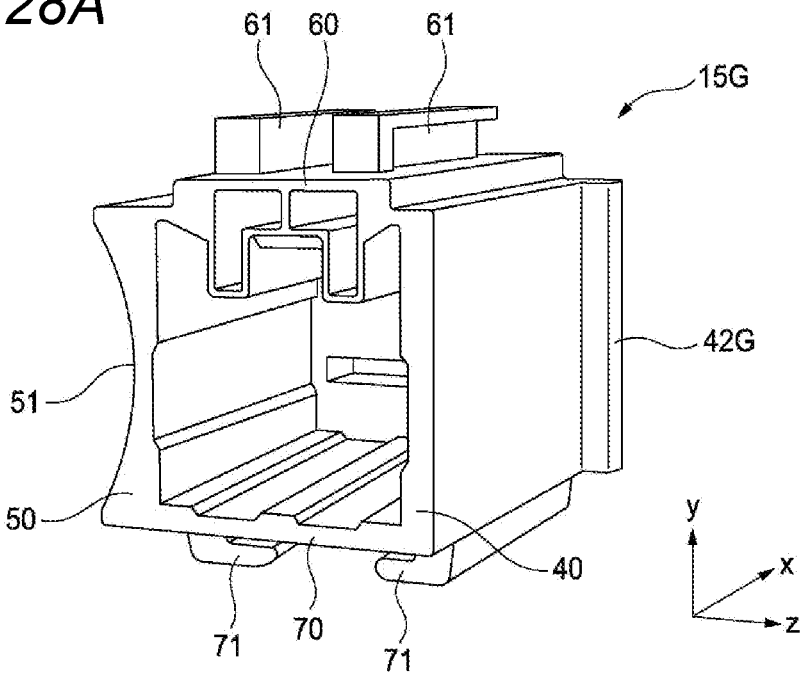
FIGS. 28A and 28B are perspective views of a sixth modification of the connector housing according to the fourth embodiment.
Figure 28B:
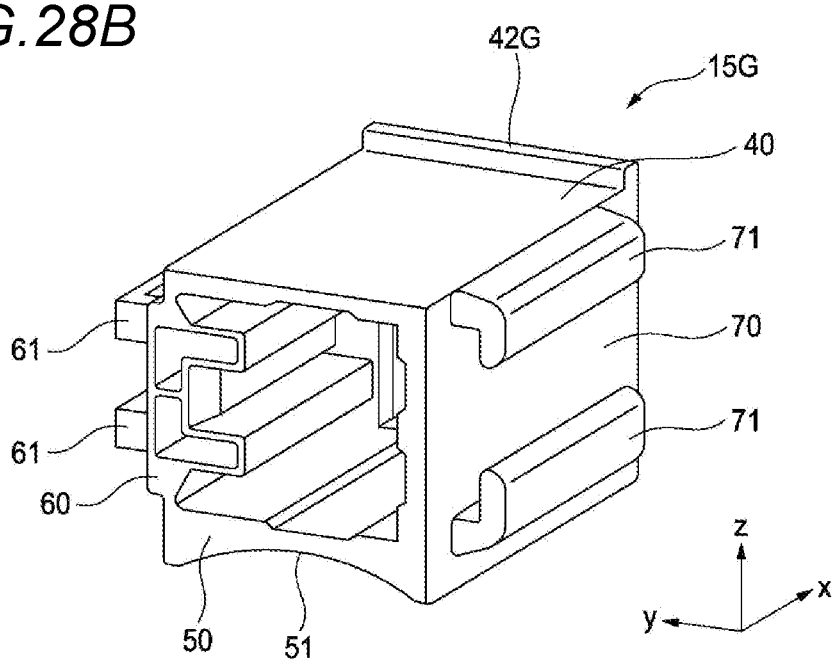

Next, referring to FIGS. 23 to 28, description is given of connector housings 15B, 15C, 15D, 15E, 15F and 15G according to the respective modifications of the fourth embodiment. FIG. 23 is a perspective view of a first modification of the connector housing according to the fourth embodiment. FIG. 24 is a perspective view of a second modification of the connector housing according to the fourth embodiment. FIG. 25 is a perspective view of a third modification of the connector housing according to the fourth embodiment. FIG. 26 is a perspective view of a fourth modification of the connector housing according to the fourth embodiment. FIG. 27 is a perspective view of a fifth modification of the connector housing according to the fourth embodiment. FIG. 28 is a perspective view of a sixth modification of the connector housing according to the fourth embodiment.

In a connector housing 15B according to the first modification of the fourth embodiment, as shown in FIG. 23, ribs 42B are formed on the outer peripheral surfaces (outer surfaces) of the front-rear two ends of the upper wall 40 but they are not formed to face each other. That is, front-side ribs 43B situated in the front-side end of the upper wall 40 are formed on the left-right direction two sides of the front-side end, while such portion of the rear-side end portion of the upper wall 40 as is situated backward of the front-side rib 43B is cut out. Meanwhile, a rear-side rib 44B situated in the rear-side end of the upper wall 40 is formed in the left-right direction central portion of the rear-side end, while such portion of the front-side end portion of the upper wall 40 as is situated forward of the rear-side rib 44B is cut out. In this manner, each rib 42B is configured such that the front-side ribs 43B and rear-side rib 44B are arranged in the front-rear two ends of the upper wall 40 alternately so as not to face each other.

Also, in the connector housing 15C according to a second modification of the fourth embodiment, as shown in FIG. 24, ribs 42C are formed on the outer peripheral surfaces (outer surfaces) of the front-rear two ends of the upper wall 40, while they are not formed so as to face each other. That is, a front-side rib 43C situated in the front-side end of the upper wall 40 is formed on the left side of the front-side end, while such portion of the rear-side end portion of the upper wall 40 as is situated rearward of the front-side rib 43C is cut out. Meanwhile, a rear-side rib 44C situated in the rear-side end of the upper wall 40 is formed on the right side of the rear-side end, while such portion of the front-side end portion of the upper wall 40 as is situated forward of the rear-side rib 44C is cut out. In this manner, each rib 42C is configured such that the front-side rib 43C and rear-side rib 44C are arranged in the front-rear direction two ends of the upper wall 40 alternately so as not to face each other.

Also, in the connector housing 15D according to a third modification of the fourth embodiment, as shown in FIG. 25, ribs 42D are formed on the outer peripheral surfaces (outer surfaces) of the front-rear two ends of the upper wall 40, while they are not formed so as to face each other. That is, a front-side rib 43D situated in the front-side end of the upper wall 40 is formed on the left side of the front-side end, while such portion of the rear-side end portion of the upper wall 40 as is situated rearward of the front-side rib 43D is cut out. Meanwhile, a rear-side rib 44D situated in the rear-side end of the upper wall 40 is formed on the right side of the rear-side end, while such portion of the front-side end portion of the upper wall 40 as is situated forward of the rear-side rib 44D is cut out. Also, the left-right direction width of the front-side rib 43D is smaller than the left-right direction width of the rear-side rib 44D. Thus, each rib 42D is configured such that the front-side rib 43D and rear-side rib 44D are arranged in the front-rear direction two ends of the upper wall 40 alternately so as not face each other.

Also, in a connector housing 15E according to a fourth modification of the fourth embodiment, as shown in FIG. 26, ribs 42E are formed on the outer peripheral surfaces (outer surfaces) of the front-rear two ends of the upper wall 40, while they are not formed so as to face each other. That is, a front-side rib 43E situated in the front-side end of the upper wall 40 is formed on the left side of the front-side end, while such portion of the rear-side end portion of the upper wall 40 as is situated rearward of the front-side rib 43E is cut out. Meanwhile, a rear-side rib 44E situated in the rear-side end of the upper wall 40 is formed on the right side of the rear-side end, while such portion of the front-side end portion of the upper wall 40 as is situated forward of the rear-side rib 44E is cut out. Also, the left-right direction width of the front-side rib 43E is longer than the left-right direction width of the rear-side rib 44E. Thus, each rib 42E is configured such that the front-side rib 43E and rear-side rib 44E are arranged in the front-rear direction two ends of the upper wall 40 alternately so as not face each other.

Also, in the connector housing 15F according to a fifth modification of the fourth embodiment, as shown in FIG. 27, a rib 42F is formed over the left-right direction whole length of the front-side end of the upper wall 40 on the outer peripheral surface (outer surface) of only the front-side end thereof, while no rib is formed on the outer peripheral surface (outer surface) of the rear-side end of the upper wall 40.

Also, in the connector housing 15G according to a sixth modification of the fourth embodiment, as shown in FIG. 28, a rib 42G is formed over the left-right direction whole length of the front-side end of the upper wall 40 on the outer peripheral surface (outer surface) of only the rear-side end thereof, while no rib is formed on the outer peripheral surface (outer surface) of the front-side end of the upper wall 40.

When the connector housing of one or more embodiments is manufactured by resin molding using a mold, two molds for forming the internal space S of the connector housing are arranged respectively in the front-rear direction of the connector housing. In this case, as described above, the ribs 42, 42B, 42C, 42D, 42E, 42F and 42G are formed so as not to face each other in the front-rear two ends of the upper wall 40 (see FIGS. 22 to 26), or they are formed in one of the front-rear two ends of the upper wall 40 (see FIGS. 27 and 28), thereby enabling simplification of mold removal. That is, when the ribs are formed at positions where they face each other in the front-rear direction two ends of the upper wall 40, it is necessary to form the ribs using a slide core which slides in the left-right direction or in the vertical direction. Meanwhile, the connector housing 15 according to the fourth embodiment eliminates mold removal using such slide core, thereby enabling simplification of the molding process thereof.

Even in the case that the ribs 42, 42B, 42C, 42D, 42E, 42F and 42G are formed in the above-mentioned manner, when winding the tape T on the connector housing 15, the tape T would be easily wound in such a manner that it is situated between the paired ribs 42, 42B, 42C, 42D and 42E, or with one of the paired ribs 42F and 42G as a reference. Also, one or more embodiments would suppress displacement of the tape T in its width direction (in the front-rear direction of the connector housing 15).

Figure 29A:
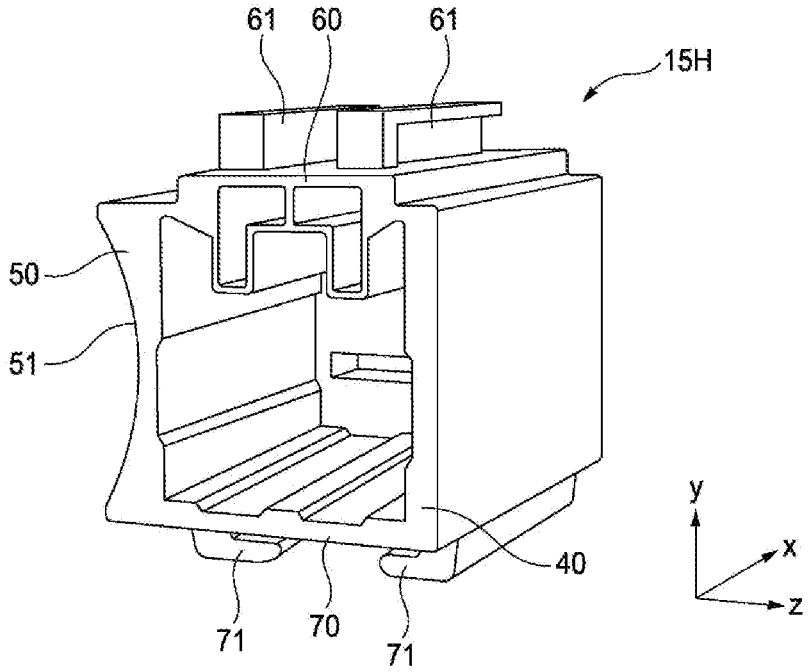
FIGS. 29A and 29B are perspective views of a reference example of the connector housing according to the fourth embodiment.
Figure 29B:
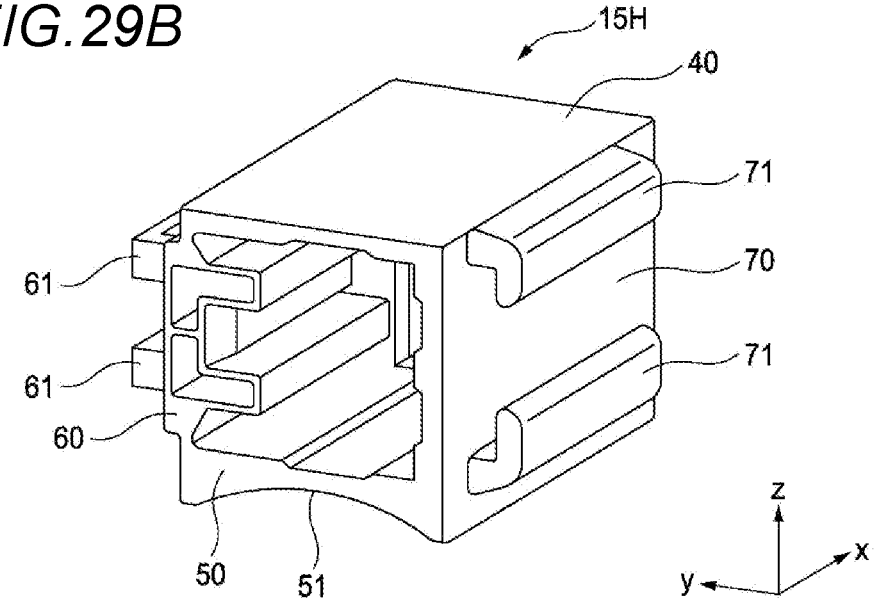

Here, only in order to attain an object to remove the mold without using the slide core, there may be employed an idea that no ribs are formed in the front-rear two ends of the upper wall 40. FIG. 29 is a perspective view of a connector housing according to a reference example of the fourth embodiment. In a connector housing 15H according to the reference example of the fourth embodiment, as shown in FIG. 29, no rib is formed on the outer peripheral surfaces (outer surfaces) of the front-side and rear-side ends of the upper wall 40. Even this configuration would simplify mold removal.

Also, the fourth embodiment is characterized by the shapes of the ribs 42, 42B, 42C, 42D, 42E, 42F and 42G. However, the shapes of other members than the ribs 42, 42B, 42C, 42D, 42E, 42F and 42G are not limited to the shapes that have been described in the first to fourth embodiments. According to one or more embodiments, in the front-rear direction two ends of the upper wall 40, the front-side rib 43 and rear-side rib 44 are arranged alternately so as not to face each other.

Other Embodiments

Here the invention is not limited to the above exemplary embodiments but various modifications may be employed. For example, the invention is not limited to the above exemplary embodiments but may be appropriately modified, improved or the like. Further, the materials, shapes, dimensions, number, arrangement locations and the like of the composing elements of the above-mentioned respective embodiments are arbitrary but not limitative so long as they can attain the object.

Also, in the second embodiment, the concave surface 51 of the lower wall 50 is configured such that it includes two kinds of arc portions having different radii of curvature. However, the concave surface 51 may also be configured to include three or more kinds of arc portions having different radii of curvature.

Also, in the second embodiment, the notch 54 is formed in the concave surface 51 of the lower wall 50 by cutting out a part of the arc portion of the concave surface 51. However, such notch may not be formed.

In accordance with exemplary embodiments as shown in the figures, a connector housing (15, 15B, 15C, 15D, 15E) has a cylindrical shape. The connector housing includes a first side wall (50) in an outer peripheral (20) of the connector housing, and a second side wall (40) in the outer peripheral (20) of the connector housing. The first side wall (50) is to be pressed against a cylindrical member (C) extending in a first direction (X). The second side wall (40) is opposed to the first side wall (50) in a second direction (Z) perpendicular to the first direction (X). The second side wall (40) is formed with a front-side rib (43, 43B, 43C, 43D, 43E) at one end of the second side wall (40) in the first direction (X) and a rear-side rib (44, 44B, 44C, 44D, 44E) at the other end of the second side wall (40) in the first direction (X). The front-side rib (43, 43B, 43C, 43D, 43E) protrudes from the second side wall (40) in the second direction (Z) and extends in a third direction (Y) which is perpendicular to both the first direction (X) and the second direction (Z). The rear-side rib (44, 44B, 44C, 44D, 44E) projects from the second side wall (40) in the second direction (Z) and extends in the third direction (Y). The front-side rib (43, 43B, 43C, 43D, 43E) and the second side rib (44, 44B, 44C, 44D, 44E) do not face to each other in the first direction (X).

According to the structure, since it is not necessary to remove the molds using the slide core, the molding process thereof would be simplified.

In accordance with exemplary embodiments as shown in Figures, a connector housing (15F, 15G) has a cylindrical shape. The connector housing has a first side wall (50) in an outer peripheral (20) of the connector housing, and a second side wall (40) in the outer peripheral (20) of the connector housing. The first side wall (50) is to be pressed against a cylindrical member (C) extending in a first direction (X). The second side wall (40) is opposed to the first side wall (50) in a second direction (Z) perpendicular to the first direction (X). The second side wall (40) is formed with a rib (42F, 42G). The rib (42F, 42G) protrudes from the second side wall (40) in the second direction (Z) and extends in a third direction (Y) which is perpendicular to both the first direction (X) and the second direction (Z). The rib (42F, 42G) is formed at only one end of the second side wall (40) in the first direction (X).

According to the structure, since it is not necessary to remove the molds using the slide core, the molding process thereof would be simplified.

According to exemplary embodiments, in a connector housing which is arranged on the outer peripheral surface of a cylindrical member and is wound with tape together with the cylindrical member, its molding process would be simplified even when manufactured using a mold.

DESCRIPTION OF REFERENCE NUMERALS AND SIGNS

10: Connector housing
11: Connector housing
12: Connector housing
13: Connector housing
14: Connector housing
15: Connector housing
15B: Connector housing
15C: Connector housing
15D: Connector housing
15E: Connector housing
15F: Connector housing
15G: Connector housing
15H: Connector housing
20: Side wall
30: Rear wall
31: Slit
40: Upper wall
41: Rib
42: Rib
42B: Rib
42C: Rib
42D: Rib
42E: Rib
42F: Rib
42G: Rib
43: Front-side rib
43B: Front-side rib
43C: Front-side rib
43D: Front-side rib
43E: Front-side rib
44: Rear-side rib
44B: Rear-side rib
44C: Rear-side rib
44D: Rear-side rib
44E: Rear-side rib
50: Lower wall
51: Concave surface
52: Arc portion
53: Arc portion

54: Notch
55: Engagement projection
56: Engagement projection
60: Left wall
61: Male-side through lock
62: Lock beak
70: Right wall
71: Female-side through lock
72: Projection
80: Connecting plate
81: Through lock
82: Through lock
90: Connecting jig
C: Corrugated tube
S: Internal space
T: Tape

What is claimed is:

1. A connector housing having a cylindrical shape, the connector housing comprising:

a first side wall in an outer periphery of the connector housing; and a second side wall in the outer periphery of the connector housing, wherein the first side wall is to be pressed against a cylindrical member extending in a first direction, wherein the second side wall is opposed to the first side wall in a second direction perpendicular to the first direction, wherein the second side wall is formed with a front-side rib at one end of the second side wall in the first direction and a rear-side rib at the other end of the second side wall in the first direction, wherein the front-side rib protrudes from the second side wall in the second direction and extends in a third direction which is perpendicular to both the first direction and the second direction, wherein the rear-side rib protrudes from the second side wall in the second direction and extends in the third direction, wherein the front-side rib and the rear-side rib do not face a structure in the first direction that protrudes from the second wall, wherein the front-side rib and the rear-side rib do not face each other in the first direction, wherein the second side wall includes an outer surface that spans uninterrupted from the front-side rib to the rear-side rib such that the outer surface is substantially flat as the outer surface spans from the front-side rib to the rear-side rib, and wherein the front-side rib and rear-side rib are discontinuous with each other.

2. The connector housing according to claim 1, wherein the front-side-rib extends in the third direction along the second side wall, and wherein the rear-side rib extends in the third direction along the second side wall.

3. The connector housing according to claim 1, wherein the front-side rib is misaligned with the rear-side rib in the first direction.

4. The connector housing according to claim 1, wherein the second side wall has a first end and a second end spaced apart from each other in the third direction, and each of the front-side rib and the rear-side rib terminates at an end that is spaced away from the first end and the second end in the third direction.

5. The connector housing according to claim 1, wherein the second side wall has a first end and a second end spaced apart from each other in the third direction, and the front-side rib extends from the first end in the third direction and terminates at location that is spaced away from the second end in the third direction, wherein the rear-side rib extends from the second end in the third direction and terminates at a location that is spaced away from to the first end in the third direction.

6. The connector housing according to claim 1, further comprising a second rear-side rib, and the front-side rib, the rear-side rib, and the second rear-side rib are staggered along the second side wall.

7. A connector housing having a cylindrical shape, the connector housing comprising:

a first side wall in an outer periphery of the connector housing; and a second side wall in the outer periphery of the connector housing, wherein the first side wall is to be pressed against a cylindrical member extending in a first direction, wherein the second side wall is opposed to the first side wall in a second direction perpendicular to the first direction, wherein the second side wall is formed with a front-side rib at one end of the second side wall in the first direction and a rear-side rib at the other end of the second side wall in the first direction, wherein the front-side rib protrudes from the second side wall in the second direction and extends in a third direction which is perpendicular to both the first direction and the second direction, wherein the rear-side rib protrudes from the second side wall in the second direction and extends in the third direction, wherein the front-side rib and the rear-side rib do not face a structure in the first direction that protrudes from the second wall, wherein the front-side rib and the rear-side rib do not face each other in the first direction, the connector housing further comprising:

a third side wall connected to and extending from each of the first side wall and the second side wall, the third side wall has an outer surface;

a fourth side wall opposing the third side wall in the third direction, the fourth side wall is connected to and extends from the each of the first side wall and the second side wall, the fourth side wall has an outer surface;

a fifth side wall connected to and extending from each of the first side wall, the second side wall, the third side wall, and the fourth side wall, the fifth side wall has an outer surface; and a third rib protruding from the second side wall in the second direction and extending in the third direction, the third rib is spaced away from the front-side rib in the first direction and the rear-side rib in the third direction, the third rib includes a first surface that is flush with the outer surface of the fourth side wall and a second surface that is flush with the outer surface of the fifth side wall, wherein the second side wall includes an end surface that is perpendicular to the first direction, wherein the front-side rib is spaced away from each of the third side wall and the fourth side wall and includes a surface that is flush with the end edge surface of the second side wall, and wherein the rear-side rib is spaced away from the fourth side wall, the rear-side rib includes a first outer surface that is flush with the outer surface of the third wall, and a second outer surface that is flush with the outer surface of the fifth side wall.

8. A connector housing having a cylindrical shape, the connector housing comprising:

a first side wall in an outer periphery of the connector housing; and a second side wall in the outer periphery of the connector housing, wherein the first side wall is to be pressed against a cylindrical member extending in a first direction, wherein the second side wall is opposed to the first side wall in a second direction perpendicular to the first direction, wherein the second side wall is formed with a front-side rib at one end of the second side wall in the first direction and a rear-side rib at the other end of the second side wall in the first direction, wherein the front-side rib protrudes from the second side wall in the second direction and extends in a third direction which is perpendicular to both the first direction and the second direction, wherein the rear-side rib protrudes from the second side wall in the second direction and extends in the third direction, wherein the front-side rib and the rear-side rib do not face a structure in the first direction that protrudes from the second wall, wherein the front-side rib and the rear-side rib do not face each other in the first direction, the connector further comprising:

a third side wall connected to and extending from each of the first side wall and the second side wall, the third side wall has an outer surface;

a fourth side wall opposing the third side wall in the third direction, the fourth side wall is connected to and extends from the each of the first side wall and the second side wall, the fourth side wall has an outer surface; and a fifth side wall connected to and extending from each of the first side wall, the second side wall, the third side wall, and the fourth side wall, the fifth side wall has an outer surface, wherein the second side wall includes an end surface that is perpendicular to the first direction, wherein the front-side rib includes a first outer surface that is flush with the outer surface of the third side wall, and a second outer surface that is flush with the end edge surface of the second side wall, and wherein the rear-side rib includes a first outer surface that is flush with the outer surface of the fourth side wall, and a second outer surface that is flush with the outer surface of the fifth side wall.

* * * * *